US008480820B2

(12) United States Patent
Takayama

(10) Patent No.: US 8,480,820 B2
(45) Date of Patent: Jul. 9, 2013

(54) FERROUS ABRASION RESISTANT SLIDING MATERIALS AND SLIDING MEMBERS

(75) Inventor: Takemori Takayama, Hirakata (JP)

(73) Assignee: Komatsu Ltd., Tokyo (JP)

( * ) Notice: Subject to any disclaimer, the term of this patent is extended or adjusted under 35 U.S.C. 154(b) by 167 days.

(21) Appl. No.: 11/095,544

(22) Filed: Apr. 1, 2005

(65) Prior Publication Data

US 2005/0217764 A1 Oct. 6, 2005

(30) Foreign Application Priority Data

Apr. 5, 2004 (JP) ..... 2004-111452
Mar. 14, 2005 (JP) ..... 2005-070656

(51) Int. Cl.
*C22C 37/10* (2006.01)

(52) U.S. Cl.
USPC ..... 148/321; 420/15

(58) Field of Classification Search
USPC ..... 148/321; 420/15
See application file for complete search history.

(56) References Cited

U.S. PATENT DOCUMENTS 3,720,504 A * 3/1973 Frehn ..... 75/237
5,082,433 A * 1/1992 Leithner ..... 419/11
6,413,328 B2 * 7/2002 Takayama et al. ..... 148/319
6,508,981 B1 * 1/2003 Perrin et al. ..... 420/28
7,078,107 B2 * 7/2006 Takayama et al. ..... 428/553
7,282,078 B2 * 10/2007 Takayama et al. ..... 75/240

FOREIGN PATENT DOCUMENTS

JP 51-59007 5/1976

* cited by examiner

*Primary Examiner* — Jie Yang
(74) *Attorney, Agent, or Firm* — Wenderoth, Lind & Ponack, L.L.P.

(57) ABSTRACT

A ferrous abrasion resistant sliding material and sliding member having improved seizing resistance, abrasion resistance and heat crack resistance are provided. The ferrous abrasion resistant sliding material has a parent phase taking the form of at least either one of a ferrite phase or a martensite phase, wherein the parent phase contains Al of 1.5 to 20 wt %, and at least either carbide, which may be selected from one or more types, of cementite, $Cr_7C_3$-type carbide, $Fe_3M_3C$-type carbide and MC-type carbide, or graphite is dispersed therein.

11 Claims, 23 Drawing Sheets
(3 of 23 Drawing Sheet(s) Filed in Color)

WHITE PHASE: CEMENTITE

WHITE PHASE: CEMENTITE
BALCK PAHSE: GRAPHITE

FERROUS ABRASION RESISTANT SLIDING MATERIALS AND SLIDING MEMBERS

FIELD OF THE INVENTION

The present invention relates to a ferrous abrasion resistant sliding material and a sliding member available for floating seals used as rollers, idlers and reduction gears and for bearings in connecting devices of construction machines.

BACKGROUND OF THE INVENTION

A track roller assembly and a reduction gear apparatus of a construction machine are equipped with ferrous floating seal for the purpose of preventing leakage of a lubrication oil from inside thereof as well as entering of earth and sand therein. Accordingly, such floating seal devices are widely produced by applying adequate treatment in which a seal sliding surface thereof is quenched to have a hard martensite structure, or a large amount of hard cementite and $Cr_7C_3$ carbide of 30% by volume are crystallized while causing a parent phase to a martensite by quenching, in order to improve seizing resistance and abrasion resistance. Such an exemplary floating seal device is made by using a Ni-hard cast iron or a high-carbon and high-Cr cast iron (for example, as shown in Japanese Parent Publication (KOKAI) NO. S51-59007).

In addition, a ferrous floating seal device in which abrasion-resistant material is splayed to a seal sliding surface thereof is sometime used for some purposes.

In the ferrous floating seal used for sealing a lubricating oil in the reduction gears and the lower track rollers, a seal sliding surface thereof is abraded as fine particles of earth and sand are entered on the seal sliding surface by hulling motion in the earth and sand, and is lubed with the sealed lubrication oil therein. Accordingly, even in a case of a most conventionally used hard ferrous floating seal device made of a high-carbon and high-Cr cast iron excellent in abrasion resistance and seizing resistance, when setting pressure (press force) at assembling is high, considerable quenching crack (heat crack), seizing and abnormal abrasion occur on the seal sliding surface, resulting in leakage of oil.

And, even if various tool steels such as a cold work tool steel and a high speed steel (SKH material) are applied so as to increase the seizing resistance and the abrasion resistance, seizing due to defect of seizing resistance easily occurs, resulting in insufficient heat crack resistance and abrasion resistance. In addition, such steels are so expensive that a material costs would increase in view of material yields before a product is finished.

Furthermore, in resent years, construction machines such as bulldozer are required to be driven at a high speed for improvement in working efficiency, and therefore, the ferrous floating seal device necessarily rotates at a high speed. This also causes quenching crack, seizing and abnormal abrasion, resulting in leakage of oil.

In order to solve the above-mentioned problem, an object of the present invention is to provide a ferrous abrasion resistant sliding material and a ferrous abrasion resistant sliding member having improved seizing resistance, abrasion resistance and heat crack resistance.

SUMMARY OF THE INVENTION

In order to solve the problems, a ferrous abrasion resistant sliding material according to the present invention has a parent phase taking the form of at least either one of a ferrite phase or a martensite phase, wherein the parent phase contains Al of 1.5 to 20 wt %, and at least either carbide, which may be selected from one or more types, of cementite, $Cr_7C_3$-type carbide, $Fe_3M_3C$-type carbide and MC-type carbide, or graphite is dispersed therein.

A sliding member according to the present invention is made of steel or cast iron, in which a sliding surface thereof has a parent phase taking the form of at least either one of a ferrite phase or a martensite phase, wherein the parent phase contains Al of 1.5 to 20 wt %, and at least either carbide, which may be selected from one or more types, of cementite, $Cr_7C_3$-type carbide, $Fe_3M_3C$-type carbide and MC-type carbide, or graphite is dispersed therein.

As described above, the present invention can provide a ferrous abrasion resistant sliding material and a sliding member having improved seizing resistance, abrasion resistance and heat crack resistance.

BRIEF DESCRIPTION OF THE DRAWINGS

The patent or application filed contains at least one drawing executed in color. Copies of this patent or patent application publication with color drawing(s) will be provided by the Office upon request and payment of the necessary fee.

DETAILED DESCRIPTION OF EMBODIMENT OF THE INVENTION

A ferrous abrasion resistant sliding material according to the present invention has a parent phase taking the form of a ferrite phase or a martensite phase, which have a order transformation of iron and Al, so as to improve adhesion resistance of the parent phase as well as to improve seizing resistance, abrasion resistance and heat crack resistance.

A ferrous abrasion resistant sliding material according to the present invention has the following characteristics.

(1) In order to improve adhesion resistance of a parent phase, Al of 1.5 to 20 wt % forms a solid solution therewith thereby to provide an order-disorder transformation.

(2) In order to improve heat crack resistance, a parent phase takes the form a ferrite phase which is age-hardened to have Vickers hardness of Hv500 or more or a martensite phase which has a solid soluble concentration of carbon of as small as 0.15 to 0.8 wt % and has Vickers hardness of Hv500 or more.

(3) One or more carbide of cementite, $Cr_7C_3$-type carbide, $Fe_3M_3C$-type carbide and MC-type carbide, having high hardness and small scraping characteristics against a counterpart surface to a sliding surface, is dispersed in the parent phase in 3% or more by volume so as to improve adhesion resistance and abrasion resistance.

(4) At least either one of a graphite or a copper alloy phase, excellent in adhesion resistance and capability for supplying an lubricating oil to a seal sliding surface (oil pocket forming capability), is dispersed and precipitated in the seal sliding surface in 3 to 20% by volume so as to improve lubricating property of the seal sliding surface, therefore to improve seizing resistance.

(5) In order to increase conformability, an alloy element such as Si, Al, Ni, Mn, Cr, V, Mo and W is suitably added so as to adjust an amount of a γ phase or a retained γ phase.

In a ferrous abrasion resistant sliding material according to the present invention, in order to improve adhesion resistance, Al of 1.5 to 20 wt % forms a solid solution therewith so that a parent phase will take the form of at least either one of a ferrite phase or a martensite phase, which show an order-disorder transformation having relation with $Fe_3Al$, Fe—Al ordered phase. In addition, the parent phase, taking the form of either one of the ferrite phase or the martensite phase, contains at least any one of carbide (one or more carbide of cementite, $Cr_7C_3$-type carbide, $Fe_3M_3C$-type carbide and MC-type carbide), graphite and copper alloy phase dispersed therein. Accordingly, a ferrous abrasion resistant material excellent in seizing resistance and abrasion resistance can be obtained.

Figure 1:
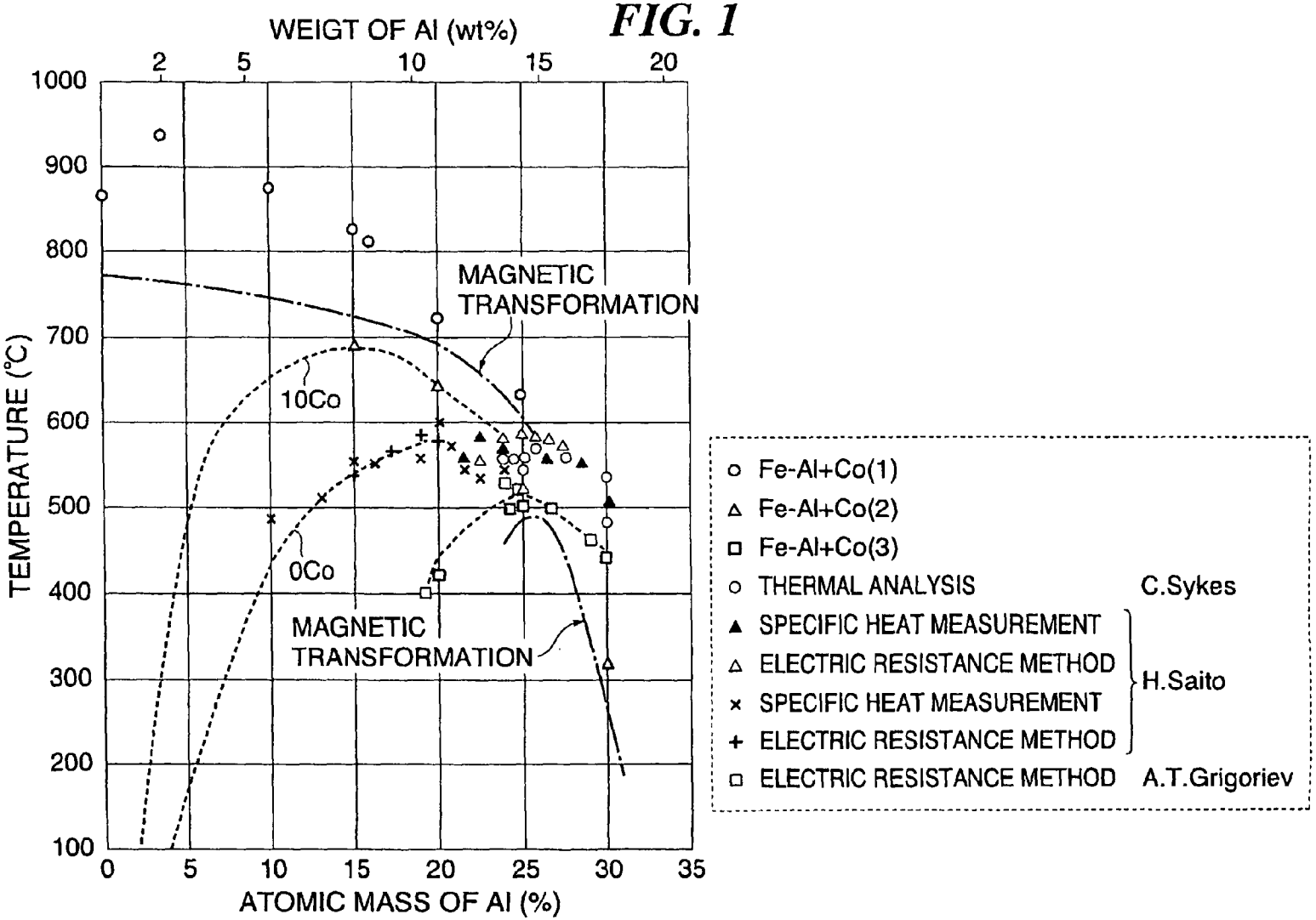
FIG. 1 is a graph showing an order-disorder transformation region of iron and aluminum.

As shown in FIG. 1 of a graph showing an order-disorder transformation region of an alloy phase of iron and aluminum, when an amount of Al is 3 wt % at the minimum, an order-disorder transformation of a ferrite phase containing iron and aluminum begins to occur. For example, if Co of 10 wt % is added, the order-disorder transformation is easy to occur at which the lower limit of an addition amount of Al is 1.5 wt %. Accordingly, it is preferable that the lower limit of an addition amount of Al is 3 wt % because an ordinality of a ferrite phase appears.

Figure 2:
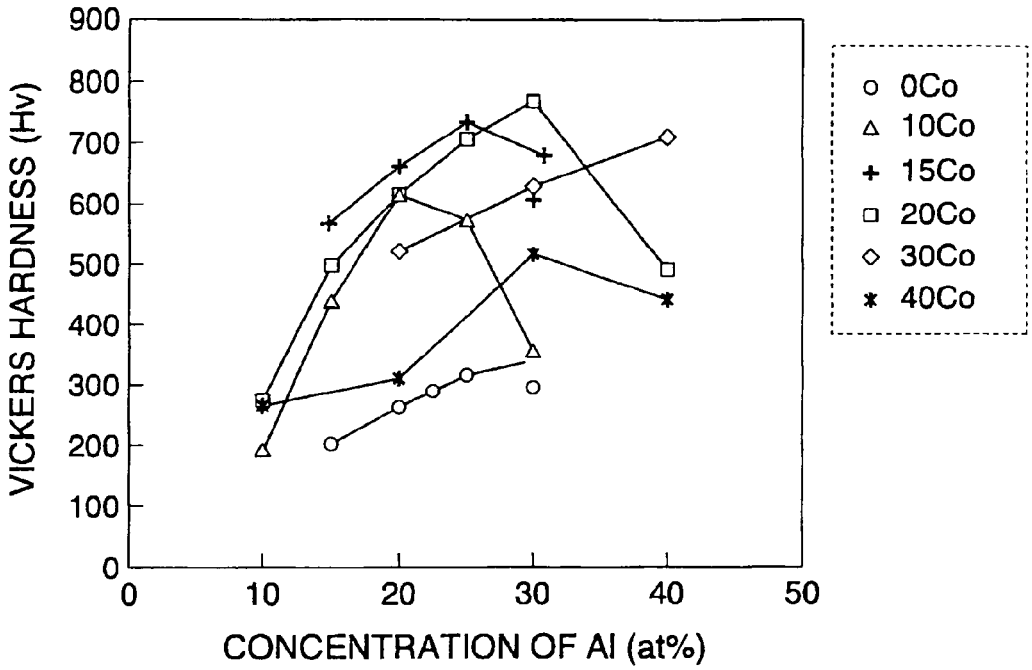
FIG. 2 is a graph showing an effect of an addition of Co for hardness of alloy phase of iron and aluminum, showing a relation between a concentration of Al (atom %) on a cross section of Co of 0, 10, 15, 20, 30 and 40 atom %, respectively, and hardness.
Figure 3A:
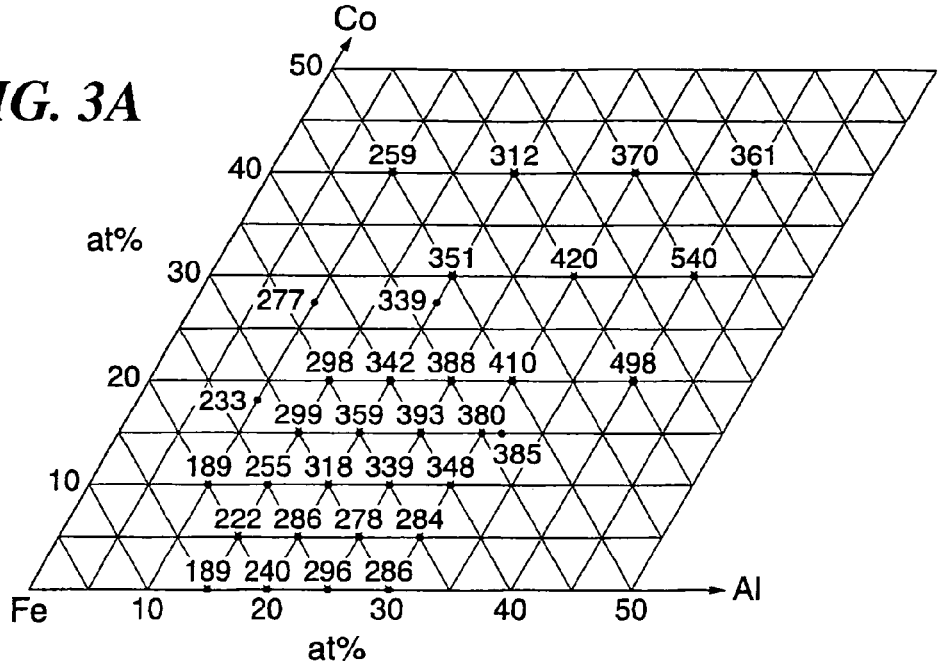
FIG. 3A is a drawing showing a distribution of Vickers hardness of a ternary metal alloy of iron, aluminum and Co which is rapidly cooled after heating at 1200° C.
Figure 3B:
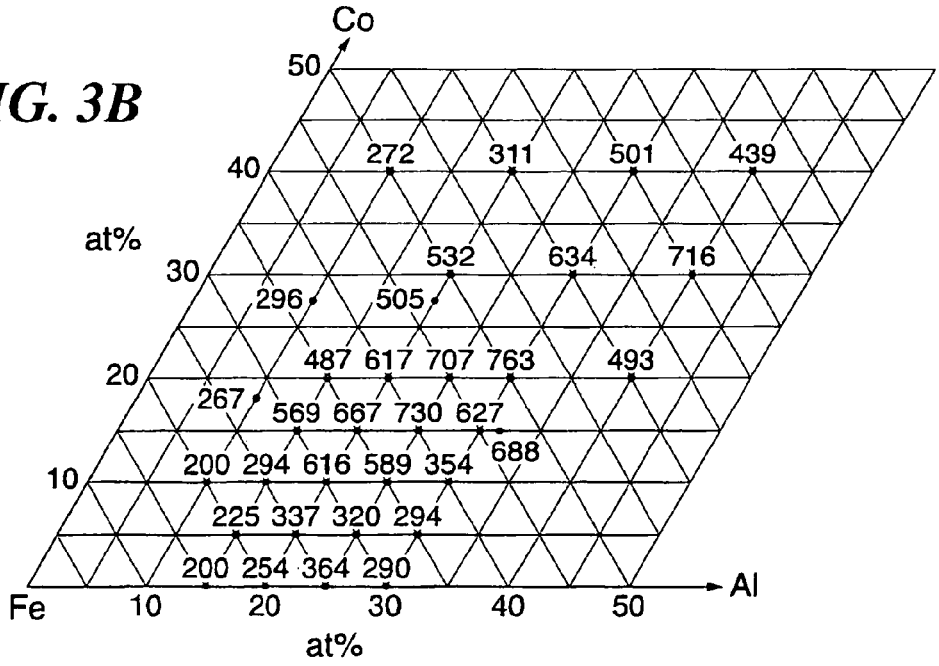
FIG. 3B is a drawing showing a distribution of Vickers hardness of the metal alloy which is age-hardened at 600° C. for 10 hours after the rapidly cooling.

For example, when a large amount of cementite coexists in 50% or more by volume, Al is discharged from the cementite and concentrated in the ferrite phase. So, an addition of Al of 1.5 wt % causes a content of Al of about 3 wt % in the ferrite phase. Accordingly, in a ferrous abrasion resistant sliding material according to the present invention, the lower limit of an addition amount of Al is set at 1.5 wt %. In addition, it is preferable that an upper limit of a content of Al in the ferrite phase is set at about 20 wt % (as show in FIG. 2 and FIG. 3) because significant hardening is demonstrated by an age hardening property described later. Accordingly, it is preferable that the upper limit of an addition amount of Al is also set at 20 wt %. However, when cementite coexists therewith in 50% by volume, the upper limit thereof is preferably set at 10 wt %.

Since the ordered phase is chemically stable more than a disordered phase, remarkable endothermal reaction is caused accompanied with disordering by local adhesion of the sliding surface and by temperature rising of the sliding surface due to frictional heat, whereby the ferrite phase is improved in adhesion resistance.

In addition, in the viewpoint of improvement in seizing resistance required for an abrasion resistant sliding material, it is preferable that graphite capable of working as a solid lubrication and an oil pocket for supplying an lubricating oil to a seal sliding surface is dispersed in the ferrite parent phase. And, in the viewpoint of the oil pocket, it is also preferable that copper alloy phase excellent in seizing resistance coexists with the material. Furthermore, in the viewpoint of dispersion of hard particles, it is also preferable that the aforesaid hard carbide (including cementite) of a suitable content (3 to 75% by volume) is dispersed so as to improve seizing resistance and abrasion resistance. Accordingly, it is preferable that graphite or the aforesaid carbide is suitably dispersed according to the application purpose.

Si is an element promoting graphitization and makes it easier to form a $Fe_3Si$ ordered phase similar as $Fe_3Al$. So, Si within the range of 0 to 5 wt % (beyond 0 wt %, less or equal to 5 wt %) may coexist with the material. The upper limit of an addition amount of Si is set at 5 wt % because an addition of Si of 5 wt % or more causes remarkable embrittlement of a cast iron.

A ferrous abrasion resistant sliding material according to the present invention is made such that a raw cast iron containing carbon of 2.5 to 5 wt %, in which a ferrite parent phase containing one or more element of Ni, Co and Mn in a total amount of 6 to 35 wt % contains one or more graphite of flake graphite, granulated graphite and vermicular graphite precipitated and dispersed therein in 3 to 15% by volume, is prepared. And, the raw cast iron is heated at a temperature of 400° C. or more so that the ferrite parent phase will be hardened (age-hardened) to have Vickers hardness of Hv500 or more and to form an ordered phase therein. This enables obtaining a ferrous abrasion resistant sliding material excellent in economical efficiency and seizing resistance.

A high carbon martensite phase is easily to cause heat crack due to friction heat at sliding. On the contrary, a ferrous abrasion resistant sliding material according to the present invention has a parent phase taking the form of a ferrite phase which is stable even in high temperature so as to demonstrate significant heat crack resistance.

Since the aforesaid alloy element such as Ni, Co and Mn is not contained in graphite but concentrated in the ferrite phase. Accordingly, it is preferable that a total addition amount of one or more element of Ni, Co and Mn is set at 6 to 35 wt %, and more preferably 6 to 25 wt % from an economical viewpoint in view of FIG. 3. Alternatively, it is also preferable that a content of Al in the ferrite phase is set at 5 to 20 wt %.

A dispersion content of graphite is preferably determined such that the lower limit thereof is 3% by volume because lubrication property (oil pocket effect) as a solid lubrication and an oil pocket inherent in graphite is obviously demonstrated, and the upper limit is 15% by volume which is a maximum content of graphite in a conventional cast iron. And, since flake graphite demonstrates the oil pocket effect more efficiently, it is preferable to disperse graphite including flake graphite mainly. In addition, since growing graphite improves lubricating property, it is preferably applied to a bearing of a construction machine. And, it is preferable that the lower limit of a dispersion amount of graphite is set at 7% by volume (a content of graphite is 7 to 15% by volume) from porosity of an oil retaining sintered material. And, it is possible that an oil retaining treatment is applied to graphite in the sliding material so as to lengthen a time interval for lubrication.

And, in order to improve abrasion resistance and seizing resistance and to prevent occurrence of abnormal noise, it is preferable that cementite, $Cr_7C_3$-type carbide and $Fe_3M_3C$-type carbide (for example, M is an element such as Mo and W) which are dispersed in tool work steels and high speed steels, and MC-type carbide such as $V_4C_3$ described later is added in a suitable amount range (3 to 75% by volume) in which scraping characteristic against a pin slid with respect to the bearing does not cause a problem.

In a ferrous abrasion resistant material used for the bearing which is likely to be loaded in high pressure and offset load, it is preferable that the upper limit of a content of graphite is 10% by volume because oil pocket effect is saturated and toughness is obtained.

A ferrous abrasion resistant sliding material used for a floating seal which requires abrasion resistance to earth and sand is expected to have more excellent abrasion resistance by dispersing a large amount of cementite in the hard ferrite phase. Accordingly, in the present invention, it is preferable that a ferrous abrasion resistant sliding material containing carbon of 0.4 to 5 wt % and having a ferrite parent phase containing at least Al of 5 to 20 wt % and one or more element of Ni, Co and Mn of 6 to 35 wt % is age-hardened at a temperature of 400° C. or more so as to have hardness of Hv500 or more and to disperse the aforesaid carbide (including cementite) in 5 to 75% by volume.

The lower limit of a dispersion amount of the aforesaid carbide (including cementite) is set at 5% or more by volume based on the fact that an amount of carbide in a high speed steel having remarkable excellence of abrasion resistant is adjusted to 3% or more by volume after quenching. However, in order to improve seizing resistance and abrasion resistance capable of withstanding a severe sliding condition, demonstrating a lot more hard particles dispersion effect is effective. Accordingly, it is preferable that the lower limit thereof is 20% by volume.

And, in order to improve abrasion resistance and seizing resistance against entering earth and sand, it is effective to disperse a larger amount of the aforesaid carbide (including cementite). Accordingly, in the present invention, the upper limit of a dispersion amount of cementite is set at 75% by volume. For example, the high-carbon and high-Cr cast iron contains carbide precipitated and diffused therein in 50% by volume. At this time, a dispersion of carbide of more than 50% by volume causes embrittlement. Accordingly, it is preferable that the upper limit of a dispersion amount of carbide is set at 50% by volume.

For example, when the cementite coexists with the ferrite parent phase in 50% by volume, an alloy element such as Al, Si, Co and Ni is discharged from the cementite, because each distribution coefficient (shown by dividing a concentration (wt %) of M (alloy element) in cementite by a concentration (wt %) of M (alloy element) in the ferrite) is represented as follows; $\alpha$KCo of Co=about 0.3, $\alpha$KNi of Ni=about 0.3, $\alpha$KAl of Al=0 and $\alpha$KSi of Si=0. For example, in order to make an amount of Co in the ferrite phase to be 7 wt %, it is necessary to add Co of about 4.5 wt %. So, it is preferable that an addition amount of Co is set at 5 to 35 wt %. And, it is preferable from an economical viewpoint that an addition amount of Co, Ni and Mn is set at 5 to 20 wt %. And, since Al hardly forms a solid solution with cementite, in order to make a content of Al in the ferrite phase to be 5 wt %, the lower limit of an addition amount of Al can decrease as small as 2.5 wt %. This is preferable from the viewpoint in producing method using a dissolution method. In addition, dispersing a large amount of cementite can decrease a consume amount of expensive alloy elements significantly, causing improvement in economical efficiency.

In order to produce a ferrous abrasion resistant sliding material excellent in abrasion resistance by dispersing a large amount of cementite in the ferrite phase in 20 to 75% by volume, it is preferable from an economical viewpoint that a chilled cast iron containing carbon of 1.5 to 5 wt % is used. At this time, even if a part or all of the parent phase may be transformed to martensite, a heating and age-hardening treatment at a temperature of 400° C. or more is applied thereto so that the high carbon martensite phase will be decomposed into a ferrite phase and fine cementite. In addition, age-hardenability of Al and an alloy element such as Co, Ni and Mn causes the ferrite phase to be hardened so as to have hardness of Hv500 or more and therefore to improve abrasion resistance. And, occurrence of heat crack caused by friction heat at sliding can be prevented.

It is possible that a graphitizing is applied to the chilled cast iron such that a large amount of cementite dispersed in the chilled cast iron is partially transformed to graphite having an average grain size of 10 μm or less and the graphite is dispersed in a parent phase in 3 to 10% by volume. This involves forming a fine-grained structure of coarse cementite and remarkable decreasing thereof, whereby it is possible to balance seizing resistance and abrasion resistance as well as to improve toughness. In addition, since an average intergranular distance of graphite becomes short, oil pocket effect is efficiently demonstrated.

It is also possible to graphitize cementite during an age-hardening treatment at 500 to 700° C. for hardening a ferrite phase, however, a processing period of the age-hardening treatment does not often correspond with the graphitization period. Accordingly, it is preferable that after the graphitization treatment at 800° C. or more, the material is rapidly cooled down and then an age-hardening treatment at 500 to 700° C. for hardening a ferrite phase is applied thereto.

It is effective for improvement in abrasion resistance to disperse harder particles, such as special carbide, nitride and carbonitride, excellent in seizing resistance remarkably, in view of high Cr work tool steels and high speed steels. In such a case, it is preferable that a ferrous abrasion resistant sliding material contains one or more element of Cr of 2.5 to 25 wt %, Mo of 3 to 15 wt % and W of 3 to 15 wt % so that one or more carbide of cementite, $Cr_7C_3$-type carbide, $Fe_3M_3C$-type carbide and MC-type carbide will be dispersed in a parent phase in 5 to 75% by volume.

An alloy element such as Cr, Mo and W can form a solid solution with cementite in a large content thereby to stabilize the cementite and to prevent graphitization of the cementite. Accordingly, in a material to which graphite is dispersed, it is necessary to adjust an addition amount of such element. On the other hand, an alloy element such as V and Ti, which forms MC-type carbide, hardly form a solid solution with cementite thereby not to prevent graphitization of cementite. Accordingly, it is preferable for improvement in abrasion resistance to disperse hard MC-type carbide excellent in seizing resistance.

And, when cementite is dispersed mainly as carbide, in view of the aforesaid relation between the cementite and an alloy element, it is preferable that a ferrous abrasion resistant sliding material contains Al of 1.5 to 10 wt % and Cr of 2.5 to 14 wt % so that a parent phase will contain cementite dispersed therein in 40 to 75% by volume.

In addition, as described later, it is possible that a surface layer which constitutes a sliding surface is carburized to have the parent phase. In such a case, it is preferable that a ferrous abrasion resistant sliding material contains one or more element of Cr of 2.5 to 25 wt %, Mo of 3 to 15 wt % and W of 3 to 15 wt % so that a surface layer which constitutes a sliding surface will be carburized to have the parent phase in which one or more carbide of cementite, $Cr_7C_3$-type carbide, $Fe_3M_3C$-type carbide and MC-type carbide is precipitated and diffused in 5 to 75% by volume.

In a case in which the oil pocket effect of graphite is employed, and in a case in which a large amount of cementite is dispersed, a ferrous abrasion resistant sliding material often embrittles. Accordingly, in the present invention, it is preferable that the ferrite phase contains copper alloy phase dispersed therein in 3 to 20% by volume.

Since the copper alloy phase is expected to demonstrate oil pocket effect as described above, the lower limit of a content of copper alloy phase is set at 3% by volume as well as graphite. On the other hand, since copper alloy phase does not cause embrittlement, a dispersion of a large amount thereof copper is allowed, however, copper alloy phase brings deterioration of abrasion resistance because of its softness. Accordingly, in the present invention, it is preferable that the upper limit of a content thereof is set at 20% by volume. And, when cementite coexists with copper alloy phase in 50% by volume, copper does not form a solid solution with the cementite. Therefore, it is preferable to add copper of at least 4 to 20 wt %.

Copper alloy particles are often utilized as a sliding material because of its excellence in adhesion resistance to a ferrous alloy metal material. And, because of its softness, copper alloy phase dispersed in the martensite parent phase is abraded slightly by carbide contained in a floating seal material at sliding to form an oil groove for supplying a lubricating oil to a sliding surface, whereby lubricating property of the sliding surface is improved. In addition, even if a very small heat crack is occurred in the sliding surface, the copper alloy particles work so as to prevent propagation of the heat crack. Accordingly, in the present invention, the lower limit of a content of copper alloy phase is set at 3% by volume because improvement in lubricating property begins to appear. A precipitation and a dispersion of the copper alloy phase does not cause embrittlement of a floating seal device, however, since increasing an amount of the copper alloy phase causes decreasing abrasion resistance of the floating seal due to its softness, it is preferable that the upper limit of a content of copper alloy phase is set at 20% by volume.

In addition, when the copper alloy phase is dispersed on a propagation direction of a very small heat crack, the propagation of the heat crack is prevented. Accordingly, in the present invention, in view of an average content (25 to 40% by volume) of carbide contained in the high-carbon and high-Cr cast iron, it is preferable that a ferrous abrasion resistant sliding material contains carbon of 2.5 to 5 wt % and has a fundamental structure in which the ferrite phase contains cementite in a content of 5 to 40% by volume and graphite in a content of 3 to 10% by volume dispersed therein, with the fundamental structure further containing copper alloy phase dispersed therein so as to contain the cementite, the graphite and the copper alloy phase in a total content of 10 to 70% by volume.

The ferrous abrasion resistant sliding material has a parent phase taking the form of a ferrite phase containing at least either one of $Fe_3Al$ or ordered phase of FeAl and hardened so as to have hardness of Hv500 or more, thereby to demonstrate excellent seizing resistance and abrasion resistance. However, since the ferrite phase contains an expensive element such as Ni, Co and Mn of 6 wt % or more, an economical problem is raised. Accordingly, in the present invention, a ferrous abrasion resistant sliding material is made such that at least Al of 1.5 to 10 wt % and one or more element of Co, Mn, Ni Cr, W and Mo of 0.05 to 7 wt % are contained so as to have a parent phase taking the form of a hard martensite phase (having hardness of Hv500 or more) by a rapid cooling treatment.

In the present invention, a ferrous abrasion resistant sliding material containing carbon of 2.5 to 5 wt %, Al of 1.5 to 10 wt % and one or more element of Ni, Co, Mn Cr, W and Mo of 0.05 to 7 wt % is quench hardened so that a martensite parent phase would have hardness of Hv500 or more, and contains one or more graphite of flake graphite, granulated graphite and vermicular graphite dispersed in the martensite parent phase in 3 to 15% by volume.

Since the martensite phase does not require an age hardening property for the ferrite phase, in the present invention, it is preferable that the upper limit of a content of Al is set at 12 wt %, which is a stoichiometrical composition of $Fe_3Al$ ordered phase as shown in FIG. 1, from an economical viewpoint. However, since a content of Al is 8 wt % or more when an order-disorder transformation temperature of the $Fe_3Al$ phase is saturated, it is preferable that a content of Al in a martensite parent phase is set at 3 to 8 wt %, more preferably 2.5 to 7 wt %.

The graphite to be dispersed operates similarly to the graphite described above. So, when a ferrous abrasion resistant sliding material according to the present invention is applied to a bearing, it is preferable that a dispersion content of graphite is set at 7 to 15% by volume.

When a raw material of a ferrous abrasion resistant sliding material according to the present invention has a parent phase taking the form of bainite, pearlite and ferrite, it is preferable that the raw material is quenched by re-heating at Al transformation temperature of the raw material or more and then rapid cooling, and then is tempered at 400° C. or less.

An alloy element such as Si, Mn, Ni, Co and Mo is added in order to ensure hardenability, and especially, an alloy element such as Si, Al, Mo, Co and Cr enhances tempering-softening resistance of a martensite phase so as to prevent decreasing the hardness of the martensite phase as much as possible by heat generation of a sliding surface. Si and Al are very operative elements so that an addition of a larger amount of Si will be preferable. However, since an addition amount thereof over 5 wt % causes embrittlement as described above, it is preferable that the upper limit of an addition amount of Si is set at 4 wt %.

And, since Cr and Mo stabilize cementite, a large amount of addition thereof prevents a precipitation of graphite at the casting process and causes a precipitation of a large amount of cementite resulting in transforming to a chilled cast iron. In such a case, it is preferable that such element is added within the range in which cementite easily graphitizes by the graphitization. So, in the present invention, it is preferable that the upper limit of an addition amount of Cr is set at 3 wt % and the upper limit of an addition amount of Mo is set at 1 wt %.

Figure 4:
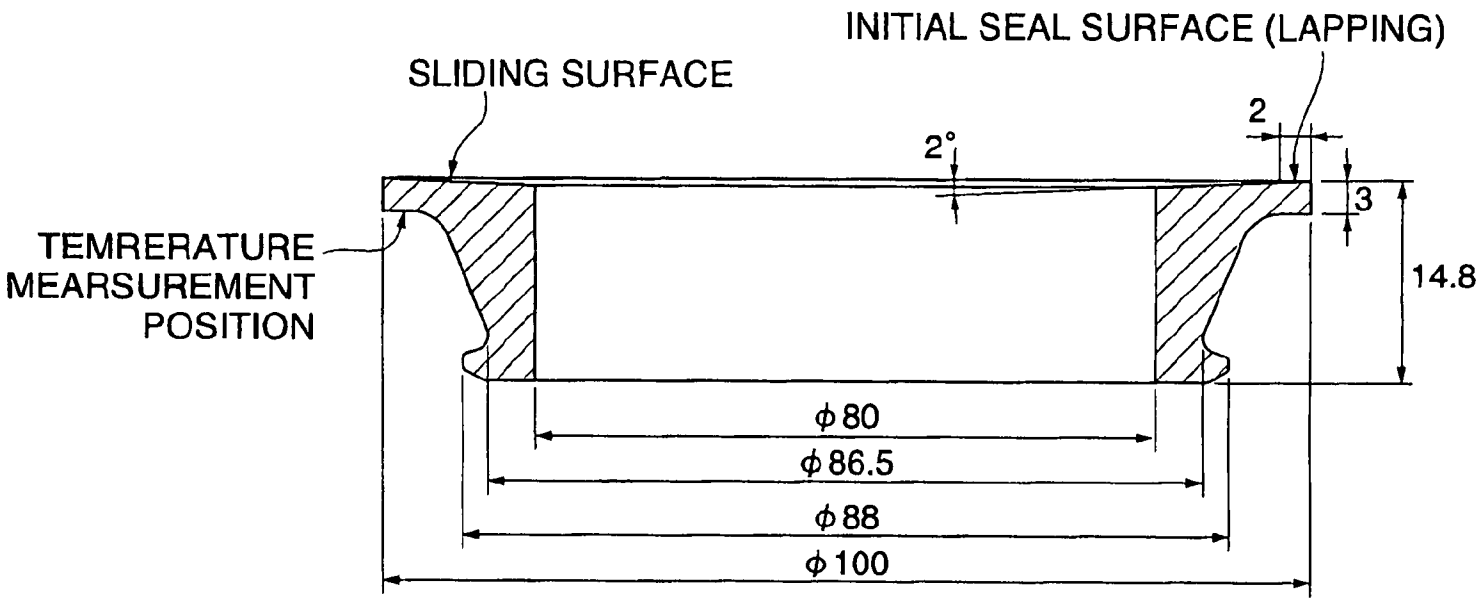
FIG. 4 is a drawing showing a structure of a floating seal.

During an operation of a floating seal device as shown in FIG. 4, a temperature of a sliding area thereof sometimes rises up to 180° C., and at this time, it is expected that a temperature of a sliding surface rises up to 400 to 500° C. Accordingly, it is preferable to maintain tempering hardness of Hv500 or more under a temperature of at least 400° C. Accordingly, in the present invention, Al of 1.5 wt % or more is added so that sufficient tempering resistance can be obtained. When Si is employed in order to obtain tempering softening resistance, it is preferable that Si of 0.5 wt % or more is added.

In the present invention, it is preferable that a ferrous abrasion resistant sliding material containing carbon of 0.4 to 5 wt %, at least Al of 1.5 to 10 wt % and one or more element of Mn, Ni, Co, Cr, W and Mo in a total amount of 0.05 to 7 wt % is quench hardened so that a martensite parent phase would have hardness of Hv500 or more, and contains carbide including cementite dispersed in the martensite parent phase in 5 to 75% by volume.

Figure 5A:
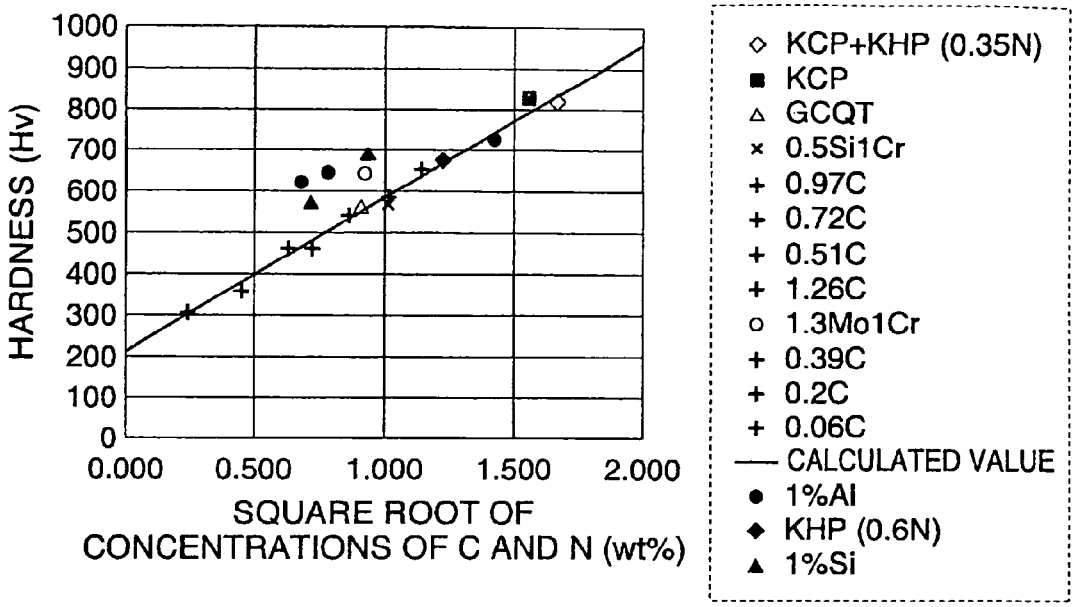
FIG. 5A is a graph showing a relation between concentrations of carbon and nitrogen and tempering hardness (at 300° C.)
Figure 5B:
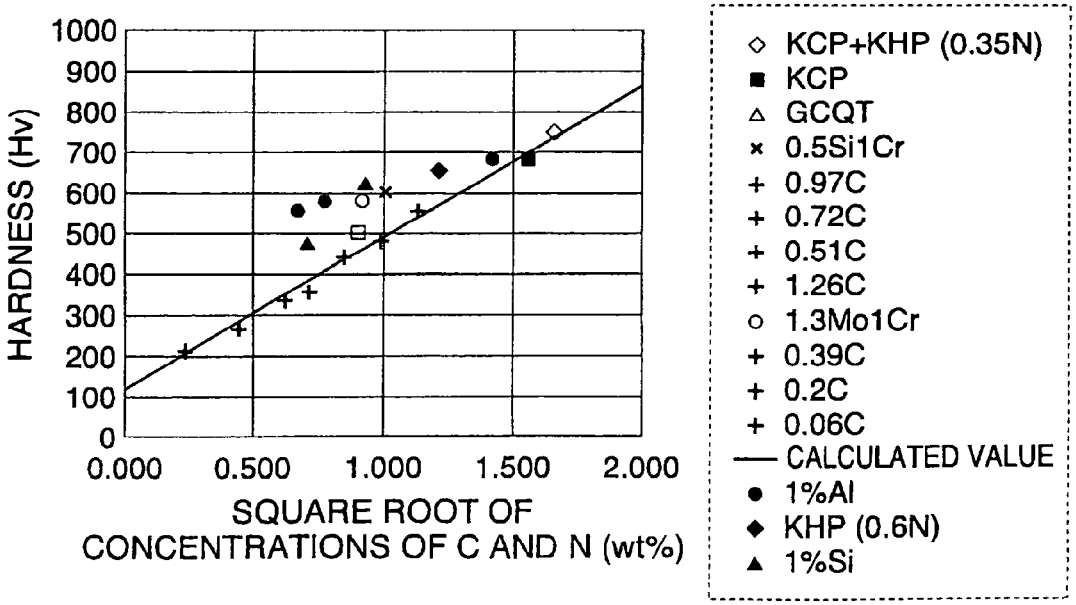
FIG. 5B is a graph showing a relation between concentrations of carbon and nitrogen and tempering hardness (at 400° C.)
Figure 5C:
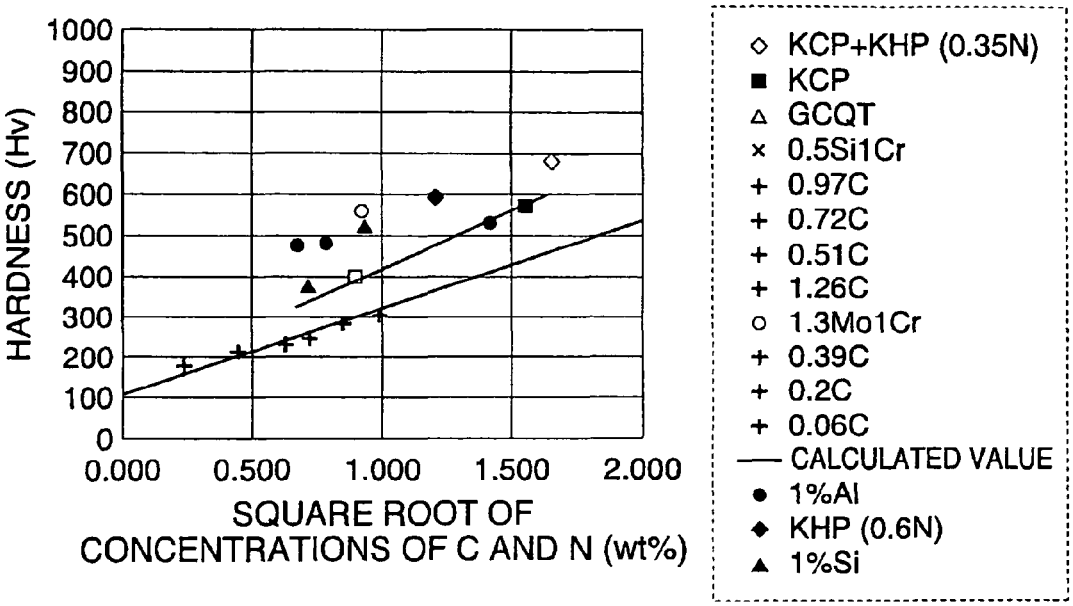
FIG. 5C is a graph showing a relation between concentrations of carbon and tempering hardness (at 1000° C.).

The cementite operates similar to the cementite as described above. From the viewpoint of tempering softening resistance, tempering hardness at 400° C. or more becomes higher in proportion to a square root of a total amount of carbon in matrix and cementite, as shown in FIG. 5. For example, a chilled cast iron (containing cementite in 25% by volume and martensite containing carbon of 0.8 wt %) containing carbon of 2.5 wt % is hardened to have tempering hardness of Hv650 or more at 400° C. From the result, a high dense dispersion of cementite is preferable from a seizing resistant viewpoint. Accordingly, in the present invention, it is preferable that carbon of 2 to 5 wt % and Al of 1.5 to 7 wt % are added so that cementite will be dispersed in 20% or more by volume.

In the present invention, it is preferable that a ferrous abrasion resistant sliding material containing carbon of 0.4 to 5 wt %, at least Al of 1.5 to 10 wt % and one or more element of Mn, Ni, Co, Cr, W and Mo in a total amount of 0.05 to 7 wt % is quench hardened so that a martensite parent phase would have hardness of Hv500 or more, and contains copper alloy phase dispersed in the martensite parent phase in 3 to 20% by volume.

And, in the present invention, a ferrous abrasion resistant sliding material contains carbon of 0.4 to 5 wt % and has a fundamental structure in which the martensite parent phase contains cementite in a content of 5 to 40% by volume, with the fundamental structure further containing at least either one of graphite or copper alloy phase dispersed therein so as to contain the cementite, the graphite and the copper alloy phase in a total content of 10 to 70% by volume. Each of the cementite, the graphite and the copper alloy phase operates similar to the cementite, the graphite and the copper alloy phase described above.

Al in the martensite phase has an irregular arrangement at the first time, however, it becomes to have the ordinality by local heating at a sliding surface, resulting in enhancing chemical stability and therefore improving adhesion resistance. And, when a martensite parent phase having an ordinality is disordered by sliding heat accompanied with adhesion, large endothermal reaction is occurred and therefore a progress of the adhesion is suppressed, whereby adhesion resistance of the martensite phase is improved.

For example, since the high carbon and high Cr cast iron conventionally used as a floating seal has a martensite parent phase containing carbon of a high concentration of 0.8 wt %, heat crack is likely to occur by friction heat at sliding due to its high carbon concentration. In such a case, an alloy element is added so as to decrease the concentration of carbon in the martensite parent phase to 0.6 wt % or less, thereby to improve heat crack resistance. On the contrary, since a ferrous abrasion resistant sliding material according to the present invention has a parent phase taking the form of a martensite phase having the order-disorder transformation, heat crack resistance is improved. And, in the ferrous abrasion resistant sliding material, the martensite parent phase has the upper limit of a concentration of carbon of at least 0.8 wt % or less, more preferable 0.7 wt % or less, and has the lower limit thereof of 0.15 wt % so as to have quenching hardness of Hv500 or more. And, in view of a concentration of carbon contained in hot work tool steels (SKD6, SKD7, SKD61, SKD62, SKD8 and 3Ni-3Mo steel) which requires high heat crack resistance, it is preferred that the upper limit of an amount of carbon which forms a solid solution with the ferrous abrasion resistant sliding material is set at 0.55 wt % and the lower limit thereof is set at 0.15 wt %.

In addition, in order to improve abrasion resistance to entering of earth and sand, it is preferable that the martensite phase has hardness of HRC50 or more. And, in order to ensure more stable heat crack resistance, it is more preferable that a concentration of carbon in the martensite phase is adjusted to within the range of 0.2 to 0.5 wt %.

A method for adjusting a concentration of carbon in a martensite parent phase will be explained. In a case of a material in which one or more graphite of flake graphite, spheroid graphite and vermicular graphite is precipitated during a casting process and a parent phase has a structure of almost a pearlite structure, it is preferable that the material is rapidly heated (for example, induction heated) from at least Al transformation temperature to a quenching temperature at a heating rate of 150° C. or more and then rapidly cooled resulting in remaining cementite pearlitely without forming a solid solution, so as to adjust a concentration of carbon in the martensite parent phase. On the other hand, in a case of a material which has a parent phase taking the form of ferrite, it is preferable that the material is heated up to Al transformation temperature or more to change the ferrite phase to an austenite phase, and carbon is diffused in the austenite phase from graphite to form a solid solution and then cooled down to change the parent phase to a structure of pearlite, and then the aforesaid rapidly heating and rapidly cooling is applied thereto.

Si, increasing carbon activity in a martensite phase remarkably, is able to decrease a concentration of carbon at a ratio of an amount of carbon of 0.1 wt % per an amount of Si of 1 wt %. Accordingly, the present invention proposes that a martensite parent phase contains carbon of 2 wt % or more. And, since Si hardly forms a solid solution with graphite and cementite, Si added to the material is concentrated in martensite remarkably. For example, in a case in which cementite is dispersed in 50% by volume, Si of a double of the addition amount is contained in the martensite parent phase. Accordingly, it is preferable that an addition amount of Si is set at 1 wt % or more.

Since an alloy element such as Al, Ni, Co and Cu works on carbon activity as well as Si, it is preferable that such alloy element is positively added.

A floating seal device made by the hard ferrous abrasion resistant sliding material requires suitable conformability. In the present invention, a ferrous abrasion resistant sliding material contains graphite and copper alloy phase, which have softness and oil pocket effect, so that suitable conformability can be obtained. In the present invention, a ferrous abrasion resistant sliding material contains one more element of Si, Mn, Ni and Co in a total amount of 2 to 7 wt % and a retained austenite phase in 10 to 40% by volume so that a sliding surface would contain a γ phase (including a retained γ phase) in 5 to 30% by volume, whereby conformability can be improved. And, in order to reduce a damage of a floating seal when earth and sand are entered to a sliding surface thereof, in the present invention, the upper limit of a content of a retained γ phase is set at 40% by volume and the lower limit thereof is set at 5% by volume based on the fact that a rolling member such as a bearing contains a retained γ phase in about 5 to 40% by volume preferably.

In ferrous abrasion resistant sliding materials according to the first to forth aspects of the present invention, a γ phase is adjusted by an addition amount of Ni and Mn and decreases abrasion resistance remarkably. Accordingly, it is preferable that a content of a γ phase is 20% or less by volume as similar to copper alloy phase. On the contrary, since about half of a retained γ phase in a martensite parent phase transforms to martensite at abrasion, not causing decreasing abrasion resistance.

A ferrous abrasion resistant sliding material according the first aspect of the present invention containing carbon of 2.5 to 5 wt % and having a ferrite phase containing Al of 5 to 20 wt % and one or more element of Ni, Co and Mn of 6 to 35 wt % is age-hardened so that the ferrite phase will have hardness of Hv500 or more, and contains one or more graphite of flake graphite, granulated graphite and vermicular graphite precipitated in the ferrite phase in 3 to 15% by volume.

A ferrous abrasion resistant sliding material according the second aspect of the present invention containing carbon of 0.4 to 5 wt % and having a ferrite phase containing Al of 5 to 20 wt % and one or more element of Ni, Co and Mn of 6 to 35 wt % is age-hardened so that the ferrite phase will have hardness of Hv500 or more, and contains the aforesaid carbide precipitated in the ferrite phase in 5 to 75% by volume.

A ferrous abrasion resistant sliding material according the third aspect of the present invention containing carbon of 0.4 to 5 wt % and having a ferrite phase containing Al of 5 to 20 wt % and one or more element of Ni, Co and Mn of 6 to 35 wt % is age-hardened so that the ferrite phase will have hardness of Hv500 or more, and contains copper alloy phase precipitated in the ferrite phase in 3 to 20% by volume.

A ferrous abrasion resistant sliding material according the forth aspect of the present invention contains carbon of 2.5 to 5 wt % and has a ferrite phase containing cementite in a content of 5 to 40% by volume, graphite in a content of 3 to 10% by volume and copper alloy phase dispersed therein so that the cementite, the graphite and the copper alloy phase will be dispersed in the ferrite phase in a total content of 10 to 70% by volume.

A half or more amount of retained austenite is transformed to martensite at sliding so as to provide conformability, resulting in hardened. On the other hand, since other retained austenite is soft, it is expected to work as the aforesaid oil pocket on a sliding surface. However, since a large amount of the soft retained austenite causes decreasing abrasion resistance, it is preferable that an amount of retained austenite should be adjusted to 10 to 40% by volume.

When a ferrous abrasion resistant sliding material which has a parent phase containing copper alloy phase dispersed therein is applied to a floating seal device, the copper alloy phase is slid with respect to a ferrous parent phase and is abraded into debris. So, it is preferable that copper alloy phase is difficult to seize with the ferrous parent phase. Accordingly, in the present invention, it is preferable that copper alloy phase contains Al of 7 to 15 wt % and has a structure composed of a mixture of a α phase and a β phase or a β phase.

As for the alloy of copper and aluminum, the β phase is significantly stabilized by Si, Ni and Mn other than Al.

MC-type carbide is mainly formed by an element such as V, W, Ti, Zr, Nb and Ta, and is the hardest carbide thereby to contribute to improvement in abrasion resistance. And, such element has little solid solubility with cementite, whereby it hardly stabilizes cementite and does not prevent precipitation of graphite. Accordingly, in the present invention, it is preferable that a ferrous abrasion resistant sliding material contains one or more element of V, Ti, Zr, Nb and Ta of 0.05 to 4 wt % so that one or more compound of carbide, nitride and carbonitride formed by the element mainly will be dispersed therein in a content of 0.1 to 10% by volume. An addition of one or more element of V, Ti, Zr, Nb and Ta of 0.05 to 4 wt % causes a dispersion of MC-type carbide in 1 to 8% by volume, causing improvement in abrasion resistance.

For example, in the case of TiC as MC-type carbide, by using a specific gravity of TiC of 4.9 g/cm$^3$, an addition of Ti of 0.5 to 4 wt % disperses TiC of 0.63 wt % (1% by volume) to 5 wt % (8% by volume), causing improvement in abrasion resistance effectively. The reason that the upper limit of an addition amount of the alloy element is set at 8% by volume is that a content of such alloy element in the aforesaid high speed steel does not exceed about 8% by volume in addition to the fact that an initial conformability is poor for a floating seal device. At least either one of the nitride or carbonitride formed by the alloy element is precipitated by containing nitrogen at an ingot step. Since such nitride and carbonitride are excellent in seizing resistance superior than carbide, it is preferable that they are positively added.

In a case in which a casting floating seal requires abrasion resistance more than anything else, it is preferable that the aforesaid carbide including harder cementite is dispersed in a larger amount. At this time, however, when a large amount carbide is dispersed by a casting process, the casting floating seal device often becomes brittles. Accordingly, in a carburized ferrous abrasion resistant sliding material according to the present invention, a steel or a casting iron containing at least one or more element of Al of 1.5 to 5 wt %, Cr of 2.5 to 14 wt % and W of 3 to 15 wt %, further one or more alloy element of carbon, Si, Ni, Mn, Mo, W, V, Ti, Zr, Nb, Ta, Cu, B and P, impurity elements such as S, O and N and residual made of iron, is prepared. And, at least sliding surface thereof is carburized so as to disperse the aforesaid carbide (including cementite) in 5 to 75% by volume, providing high toughness. At this time, it is preferable from an economical viewpoint that an addition amount of Mo and W is held at 7 wt % or less and cementite is dispersed in 40 to 75% by volume. The steel or the cast iron has a parent phase which takes the form of either one of a ferrite phase or a martensite phase, with the parent phase contained at least either one of carbide or graphite dispersed therein. And, it is preferable that the steel or the cast iron further contain Co of 0.05 to 10 wt %.

In addition, it is possible that the parent phase contains Si of 5 wt % or less. It is also possible that the steel or the cast iron containing carbon of 0.4 to 5 wt %, Al of 1.5 to 10 wt % and one or more element of Ni, Co, Mn, Cr, W and Mo of 0.05 to 7 wt % is quench hardened so that the martensite phase would have hardness of Hv500 or more, and contains carbide dispersed in the martensite phase in 5 to 75% by volume. At this time, it is preferable that the martensite phase contains carbon of 0.15 to 0.7 wt %. Furthermore, it is possible that the steel or the cast iron contains one or more element of Si, Mn, Ni and Co of 2 to 7 wt % and a retained austenite phase in a content of 10 to 40% by volume. And, it is also possible that the steel or the cast iron containing one or more alloy element of V, Ti, Zr, Nb and Ta of 0.05 to 4 wt % and one or more compound of carbide, nitride and carbonitride formed by the alloy element is dispersed in 0.1 to 10% by volume.

Figure 6:
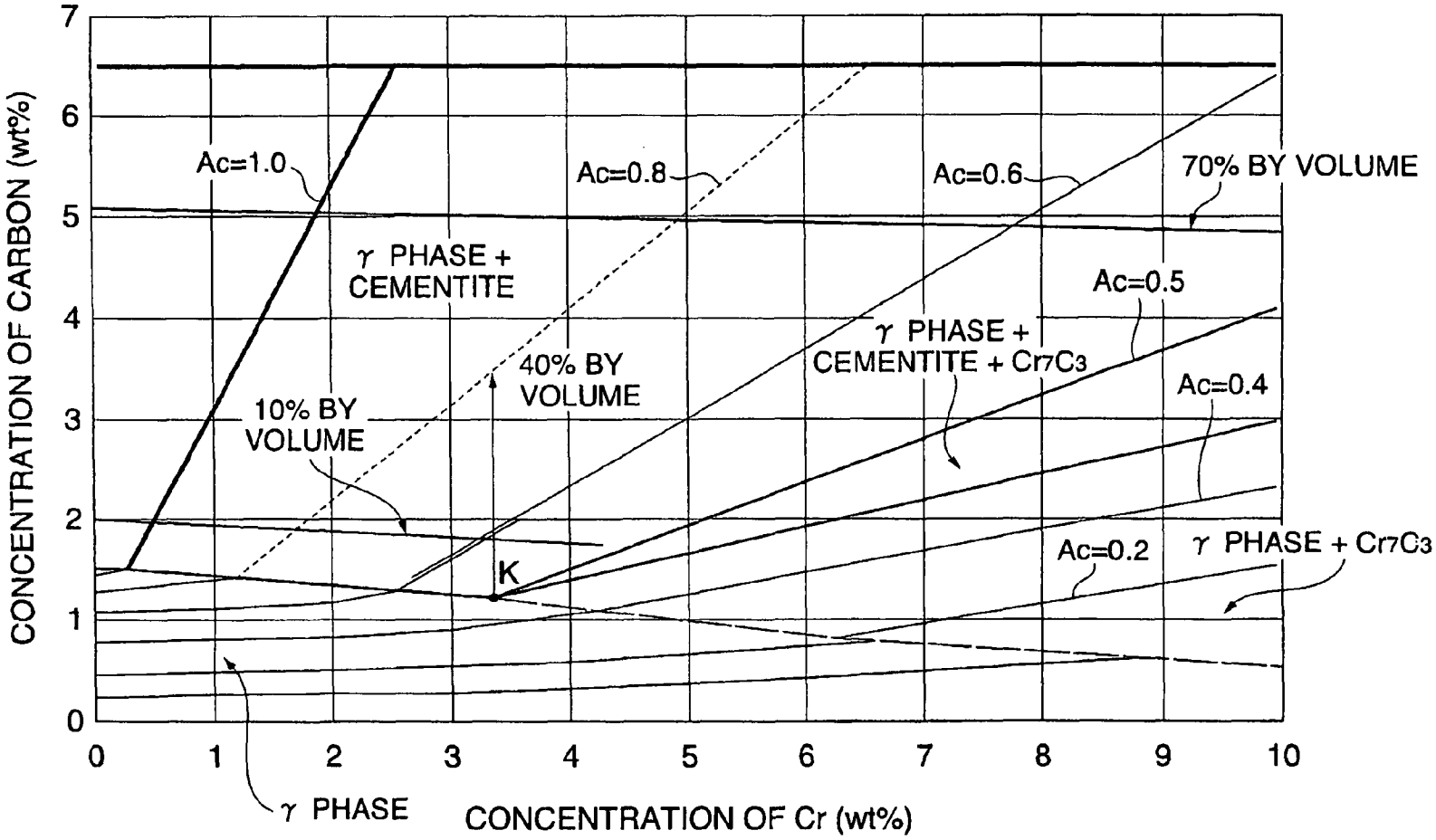
FIG. 6 is a drawing showing a constant carbon activity line of iron, carbon and Cr (at 1000° C.).

When cementite is formed by a carburizing treatment or a carbonitriding treatment, it is necessary that such a treatment is carried out under high carbon activity (Ac). In order to operate a carburizing furnace stably, it is assumed to operate within the range of Ac=0.5 to Ac=0.8, referred to a ternary diagram of iron, carbon and Cr (at 1000° C.) as shown in FIG. 6. And, in order to precipitate at least $Cr_7C_3$-type carbide before precipitation of cementite and then to uniformly precipitate a large amount of cementite with the precipitated carbide as a nucleus, it is preferable that the lower limit of an amount of Cr is an amount represented in a point K within a ternary coexistent region where austenite γ, cementite and $Cr_7C_3$-type carbide coexist, and the upper limit thereof is 14 wt % at which cementite is precipitated in 70% by volume under a carburizing at Ac=0.5, and more preferably 8 wt % from an economical viewpoint.

In the present invention, a hard phase in which hard $Cr_7C_3$ carbide is precipitated is formed under a sliding surface phase in which cementite is dispersed. Accordingly, since the hard phase containing a larger amount of hard $Cr_7C_3$-type carbide remains even if the surface phase having cementite dispersed disappears by abrasion, it is preferable from the quality.

It is not preferable that at least either one of nitride such as VN, AlN and TiAlN or carbonitride such as TiCN is dispersed by a carburizing treatment, because Al necessary for forming a $Fe_3Al$ ordered phase consumes as AlN. Accordingly, in the present invention, it is preferable that a carburizing treatment is carried out under a condition free of nitrogen gas.

A sliding member according to the present invention employing the aforesaid properties of the ferrous abrasion resistant sliding material is made of a steel or a cast iron, in which a sliding surface thereof has a parent phase taking the form of at least either one of a ferrite phase or a martensite phase, with the parent phase contained Al of 5 to 20 wt % and at least either carbide, which may be selected from one or more types, of cementite, $Cr_7C_3$-type carbide, $Fe_3M_3C$-type carbide and MC-type carbide, or graphite. At this time, it is preferable that the parent phase contains Si of 5 wt % or less. And, it is preferable that the steel or the cast iron containing carbon of 0.4 to 5 wt % and having a ferrite phase containing Al of 5 to 20 wt % and one or more element of Ni, Co and Mn in a total amount of 6 to 35 wt % is age-hardened so that the ferrite phase would have hardness of Hv500 or more. And, it is preferable that the steel or the cast iron containing carbon of 0.4 to 5 wt %, Al of 1.5 to 10 wt % and one or more element of Ni, Co, Mn, Cr and Mo in a total amount of 0.05 to 7 wt % is quench hardened so that a martensite phase would have hardness of Hv500 or more. And, it is preferable that the parent phase contains one or more graphite of flake graphite, granulated graphite and vermicular graphite precipitated therein in 3 to 15% by volume. Furthermore, it is also preferable that the parent phase contains carbide precipitated therein in 5 to 75% by volume, and that the parent phase contains copper alloy phase precipitated therein in 3 to 20% by volume.

High performance abrasion resistant sliding members made of a ferrous abrasion resistant sliding material or a sliding member according to the present invention includes a floating seal equipped for a roller and a mechanical reduction gear of a construction machine, a thrust bearing equipped for a connecting device of construction machine, a spherical bearing equipped for a suspension device, a spherical bearing equipped for a equalizer supporting a vehicle body, a hydraulic member equipped for a hydraulic pump and a hydraulic motor, a valve equipped for an engine valve, a wedge or a wedge guide equipped for a rock breaking equipment and the like.

There will be explained a ferrous abrasion resistant sliding material and a sliding member according to preferred embodiment of the present invention.

In order to produce a casting floating seal device produced by using an inexpensive casting method, a raw cast iron material containing at least carbon of 2.5 to 5 wt %, Al of 2.5 to 25 wt %, one or more alloy element of Ni, Mn and Co of 5 to 35 wt %, one or more alloy element of Si, Mn, Ni, Co, Cr, Mo, W, Cu, V, Ti, Nb, Zr, Ta, B and P, impurity element such as S, O and N and residual made of iron is prepared. The raw cast iron material is age-hardened at 400° C. or more so that the material will have the parent phase taking the form of the ferrite phase having hardness of Hv500 or more, and contains at least graphite dispersed in the parent phase in 3 to 15% by volume.

In addition, a raw cast iron material containing at least carbon of 0.4 to 5 wt %, Al of 1.5 to 25 wt %, one or more alloy element of Mn, Ni and Co of 4 to 35 wt %, one or more alloy element of Si, Mn, Ni, Co, Cr, Mo, W, Cu, V, Ti, Nb, Ta, B and P, impurity element such as S, O and N and residual made of iron is prepared. The raw cast iron material is age-hardened at 400° C. or more so that the material will have the parent phase taking a ferrite phase having hardness of Hv500 or more, and contains cementite dispersed in the parent phase in at least 5 to 75% by volume. In this case, for the purpose of enhancing heat resistance and softening resistance of a sliding surface, thereby improving seizing resistance and abrasion resistance as well as economical efficiency by decreasing an addition amount of alloy element, it is preferable that the raw material contains carbon of 1.5 to 5 wt % so that cementite would be dispersed in at least 20 to 75% by volume. And, it is preferable that Cr of 0.5 to 5 wt % is added, for the purpose of suppressing a precipitation of graphite during a casting process and preventing a decomposition of cementite into graphite too much during an age-hardening of the ferrite.

Cementite contained in the chilled cast iron has hardness of about Hv800 to 1300 smaller than special carbide of Cr, Mo and V, whereby it has small scraping characteristic against the counterpart to a sliding surface and excellent toughness compared with special carbide. In addition, since cementite is a ferromagnetic material having a magnetic transformation temperature of 215° C., a λ type endothermic reaction remarkably appears by a magnetic transformation at the vicinity of such magnetic transformation temperature. This gives preferable effect for preventing lack of lubricating property caused by a temperature rise of the sliding surface where a large amount of cementite is precipitated. At this time, it is preferable that a magnetic transformation temperature is adjusted to 60 to 180° C. Viscosity of a lubricating oil begins to decrease at 60° C., and the lubricating oil deteriorate at 180° C. When a temperature is within the range of from 60° C. to 180° C., lubricating property of the sliding surface is improved by the remarkable endothermy, therefore improving seizing resistance. In the present invention, it is preferable that an amount of Mn, Cr and V, which are easily concentrated in cementite, is adjusted.

Effect of an alloy element to a magnetic transformation temperature (A0) of cementite is shown the following equation.

$$A0=215^\circ\text{ C.}-16\times\text{an amount of Cr (wt \%)}-24\times\text{an amount of Mn (wt \%)}-16\times\text{an amount of Mo (wt \%)}-19\times\text{an amount of W (wt \%)}+3.7\times\text{an amount of Ni (wt \%)}+8.7\times\text{an amount of Co (wt \%)}-57\times\text{an amount of V (wt \%) (in a case of an addition amount of V less than 2 wt \%)} \quad (1)$$

$$A0=181^\circ\text{ C.}-16\times\text{an amount of Cr (wt \%)}-24\times\text{an amount of Mn (wt \%)}-16\times\text{an amount of Mo (wt \%)}-19\times\text{an amount of W (wt \%)}+3.7\times\text{an amount of Ni (wt \%)}+8.7\times\text{an amount of Co (wt \%) (in a case of a saturation state in which a concentration of V is 0.6 wt \%)} \quad (2)$$

From these equations, V of 0.6 wt % or more does not form a solid solution with cementite and a magnetic transformation temperature of cementite becomes constant at a temperature of 181° C. In the present invention, it is preferable that V of 0.6 wt % forms a solid solution with cementite. For example, when cementite is dispersed in 25% by volume, by using a distribution coefficient $\alpha KV=9$, an addition of V of 0.2 wt % or more is required. Accordingly, it is preferable that V of 0.2 wt % or more is added and an addition amount of each of Mn and Cr is adjusted so that a magnetic transformation temperature of cementite will be adjusted within the range of 60 to 180° C.

When a content of coarse cementite crystallized during the chilling process is adjusted to 50% or more by volume, a floating seal device becomes brittle. In order to prevent a floating seal from embrittling, it is preferable that adjustment of a content of the cementite and forming a fine-structure of the coarse cementite are carried out by graphitization. Accordingly, in a casting floating seal device according to the present invention, it is preferable that coarse cementite dispersed therein is graphitized so as to form a fine-grained structure so that cementite in a content of at least 5 to 40% by volume and graphite in a content of 3 to 10% by volume will be dispersed therein.

Since concentrating Cr in cementite too much delays graphitization of the cementite, the upper limit of an addition amount of Cr is set at 5 wt % from an economical viewpoint. In some cases, $Cr_7C_3$-type carbide may be crystallized by segregation during the solidification process, however, such $Cr_7C_3$-type carbide is dispersed in a conventionally used floating seal device. Accordingly, $Cr_7C_3$-type carbide is allowed to be dispersed in 10% or less by volume from a sliding property.

In each of the casting floating seal devices, it is possible that copper alloy phase is dispersed in a ferrite parent phase.

In addition, another casting floating seal is made such that a raw material containing at least Al of 1.5 to 20 wt %, preferably 3 to 8 wt %, and one or more alloy element of Si, Mn, Ni, Cr and Mo of 0.5 to 6 wt % is rapidly cooled (quenched) so as to have a parent phase taking the form of a martensite phase having high hardness of Hv500 or more, with the martensite parent phase contained one or more graphite of flake graphite, granulated graphite and vermicular graphite dispersed therein in 3 to 15% by volume. And, it is preferable that the martensite parent phase contains cementite dispersed therein in 5 to 75% by volume, more preferably 20 to 75% by volume. Or, it is also preferable that the martensite parent phase contains at least cementite in a content of 5 to 40% by volume and graphite in a content of 3 to 10% by volume dispersed therein. Furthermore, it is preferable that the martensite parent phase contains carbon of 0.15 to 0.7 wt %, more preferably 0.2 to 0.6 wt %. In addition, it is preferable that the martensite parent phase contains copper alloy phase dispersed therein in 20% or less by volume.

In order to graphitize a part of cementite in a raw material for a casting floating seal, it is preferable that one or more element of Si and Ni, which are elements promoting graphitization, of 2 to 7 wt % is contained. In order to precipitate cementite efficiently, an addition of Cr of 0.5 to 5 wt % is necessary as described above. When a parent phase is reheated and quenched at a casting state, it is preferable that Cr of 0.5 to 5 wt % is added in order to prevent graphitization of cementite at a re-heating temperature.

And, it is preferable that a parent phase containing Cr is changed to a pearlite structure (platy cementite and ferrite), and after rapidly heating to Al transformation temperature to a quenching temperature at a heating rate of 150° C./sec or more, the parent phase is rapidly cooled (quenched) so as to disperse cementite pearlitely in the martensite parent phase.

Ni promotes graphitization as well as enhances hardenability, and works so as to form retained austenite, causing improvement in conformability of a floating seal, therefore improves seizing resistance. In the present invention, it is preferable that Ni of 1 wt % or more is added. However, if a content of retained austenite too increases, abrasion resistance decreases. Accordingly, the upper limit of an addition amount of Ni is preferably set at 5 wt % from the abrasion resistant viewpoint and an economical viewpoint.

Mn stabilizes austenite as well as Ni, and forms retained austenite phase. In addition, Mn is inexpensive. So, in the present invention, it is preferable that Mn of 2 wt % or less is added.

In order to more improve abrasion resistant of a raw material for a casting floating seal, it is preferable to disperse harder cementite in a larger amount. However, when a large amount of cementite is dispersed by a casting process, the casting floating seal sometimes embrittles too much. Accordingly, a floating seal device is produced by a carburizing method. The carburized floating seal device is made such that a steel containing at least Al of 1.5 to 10 wt %, Cr of 3 to 14 wt %, one or more alloy element of carbon, C, Si, Al, Ni, Mn, Mo, W, V, Ti, Zr, Nb, Ta, Cu, Co, B and P, impurity element such as S, O and N and residual made of iron is prepared. And, the steel is carburized or carbonitrided at a sliding surface so that cementite will be dispersed in the sliding surface in 30 to 70% by volume, providing a high toughness structure.

When cementite is formed by a carburizing treatment or a carbonitriding treatment, it is necessary that the treatment is carried out under high carbon activity (Ac). In order to operate a carburizing furnace stably, it is assumed to operate within the range of Ac=0.5 to Ac=0.8, referred to a ternary diagram of iron, carbon and Cr (at 1000° C.) as shown in FIG. 6. And, $Cr_7C_3$-type carbide is once precipitated before precipitation of cementite, and then cementite is uniformly precipitated in a large amount with the precipitated carbide as a nucleus. For this purpose, it is preferable that the lower limit of an amount of Cr is an amount represented in a point K within a ternary coexistent region where austenite γ, cementite and $Cr_7C_3$-type carbide coexist, and the upper limit thereof is 14 wt % at which cementite is precipitated in 70% by volume under a carburizing at Ac=0.5, and more preferably 8 wt % from an economical viewpoint.

In the present invention, a hard phase in which hard $Cr_7C_3$-type carbide is precipitated is formed under a surface phase in which cementite is dispersed. Accordingly, it is preferable from the quality that the hard phase containing a larger amount of hard $Cr_7C_3$-type carbide remains even if the surface phase having cementite dispersed disappears by abrasion.

It is not preferable that at least either one of nitride such as VN, AlN and TiAlN or carbonitride such as TiCN is dispersed by a carburizing treatment, because Al necessary for forming a $Fe_3Al$ ordered phase consumes as AlN. Accordingly, in the present invention, it is preferable that a carburizing treatment is carried out under a condition free of nitrogen gas.

And, when a material in which a ferrite phase coexistent with a cementite phase before quenching is equilibrium heated at 700° C., a distribution coefficient αKM of an alloy element M is shown by dividing a concentration (wt %) of the alloy element M in the cementite phase by a concentration (wt %) of the alloy element M in the ferrite phase, for example, each distribution coefficient is represented as follows; αKCr of Cr=28, αKMn of Mn=10.5, αKV of V=9, αKMo of Mo=7.5, αKW of W=2, αKNi of Ni=0.34, αKCo of Co=0.23, αKSi of Si=approximately 0 and αKAl of Al=approximately 0. From the distribution coefficients, it is understood that Mn, Cr, Mo, V and W are concentrated in cementite; Si, Al, Ni and Co are concentrated in ferrite.

Example 1

Figure 7:
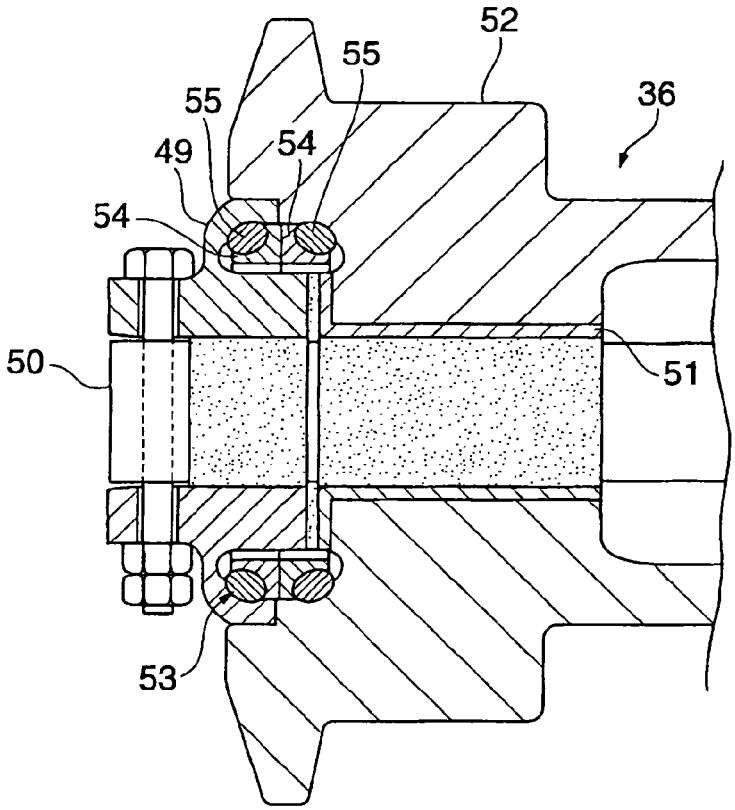
FIG. 7 is a drawing showing a principle part of a roller.

Next, an embodiment in which a ferrous abrasion resistant sliding material according to the present invention is applied to a floating seal device in a roller assembly will be described in detail with reference to the accompanying drawings. FIG. 7 is a drawing showing a principle part of the roller assembly.

The roller assembly 36, according to the embodiment, has a roller retainer 49, a roller shaft 50 supported by the retainer 49, a roller bushing (collar bushing) 51 fitted onto the shaft 50 and a roller 52 arranged through the bushing 51, which are rotatably connected each other. A floating seal device 53 is provided with one pair of seal rings 54 with seal surfaces contacted each other and an O-ring 55 fitted onto each of the seal ring 54. In the roller assembly 36, the floating seal device 53 is arranged such that the contacted seal surfaces of the seal rings 54 are pressed toward the shaft 50 by elastic force of the compressed O-rings 55. The seal surfaces are relatively slidable while being pressed each other at an adequate pressure so as to prevent entering water or earth and sand from outside, as well as preventing leakage of lubricating oil from inside. The seal surface of the seal rings 54 has a structure in which carbide in a content of at least 5 to 70% by volume and at least either one of graphite or copper alloy particles are dispersed in a ferrite phase having a hard ordered phase or a martensite phase having a order transformation.

In a large diameter floating seal device used for a reduction gear apparatus, a diameter of the seal ring becomes so large that a sliding rate of the seal surface becomes high. Accordingly, a floating seal ring excellent in higher seizing resistance and higher heat crack resistance is required. In order to obtain a floating seal used under a sliding rate of 1 m/sec or more, in the present invention, the floating seal is made of a material of which a parent phase takes the form of a ferrite phase having a hard ordered phase or a martensite phase having an order transformation, and contains copper alloy phase dispersed therein in order to prevent propagation of heat crack and at least either one of graphite or copper alloy phase dispersed therein in 3 to 20% by volume in order to improve lubricating property of a sliding surface.

According to the present invention, a floating seal device excellent in seizing resistance and heat crack resistance can be provided. Furthermore, in order to improve economical efficiency and more improve heat crack resistance and seizing resistance, it is preferable that an addition amount of each of an alloy element such as Si, Cr, Cu, Mo, W and V is adjusted so that a martensite phase will have a solid soluble concentration of carbon of 0.15 to 0.7 wt %, an addition amount of each of V, Mn and Cr is adjusted so that cementite will have a magnetic transformation temperature of 60 to 180° C., and at least either one of graphite particles or copper alloy particles are dispersed so as to promote lubricating property. A preferable heat treatment method in which a solid soluble concentration of carbon in a martensite parent phase is adjusted to 0.15 to 0.7 wt % is such that a material for a floating seal device is heated from Al transformation temperature to a quenching temperature at a heating rate of 150° C./sec or more by induction heating capable of rapidly heating, and then quenched so as to have a structure in which pearlitely cementite is dispersed in a martensite parent phase. In addition, it is preferable that a solid soluble concentration of carbon in a martensite parent phase is adjusted to 0.2 to 0.5 wt %.

Figure 8A:
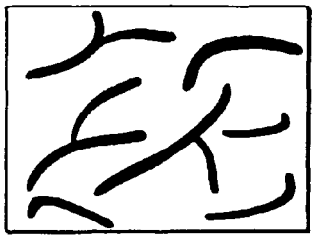
FIG. 8A is a drawing showing flake graphite dispersed in a cast iron.
Figure 8B:
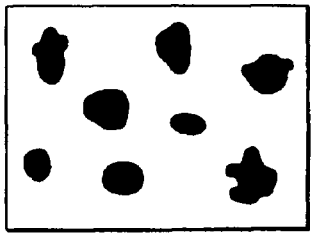
FIG. 8B is a drawing showing spheroidal graphite dispersed in a cast iron.
Figure 8C:
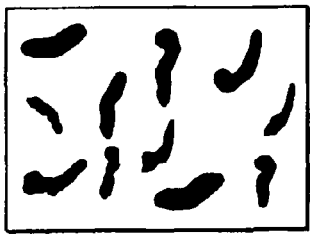
FIG. 8C is a drawing showing vermicular graphite dispersed in a cast iron and FIG. 8D is a drawing showing black heart malleable cast iron dispersed in a cast iron.
Figure 8D:
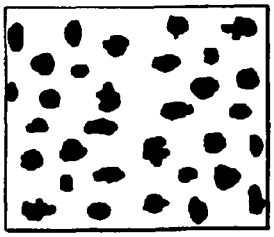
Figure 9:
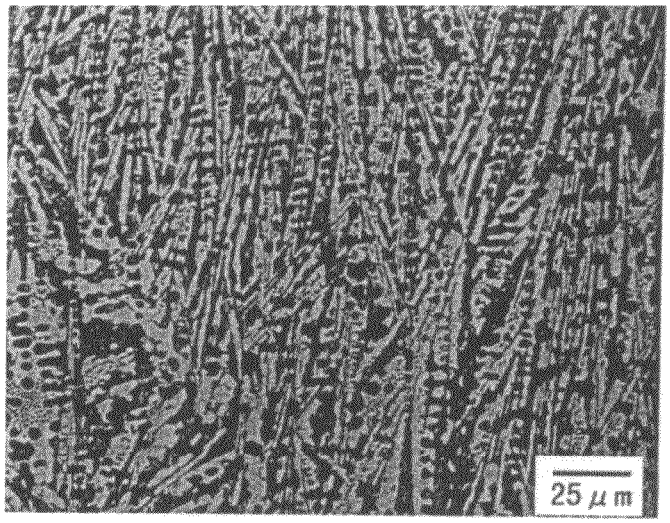
FIG. 9 is a photograph showing a typical quenched chilled cast iron.
Figure 10:
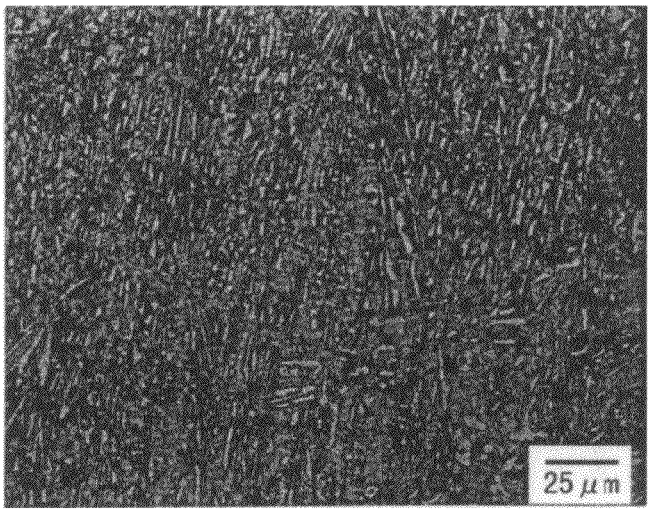
FIG. 10 is a photograph showing a graphitized chilled cast iron of FIG. 9.

FIG. 8 to FIG. 10 are drawings showing typical metallographical structures of a ferrous abrasion resistant sliding material available for producing by using a casting process.

FIG. 8 are drawings showing various structures of graphite dispersed in a cast iron. FIG. 8A shows graphite flake, FIG. 8B shows spheroidal graphite, and FIG. 8C shows vermicular graphite. Each of the graphite appears in a large amount at a solidification process and has a parent phase each taking the form of a ferrite, pearlite, martensite and bainite structures. In the present invention, an age-hardening treatment is applied in a region in which a ferrite phase exists within the temperature range of 400 to 750° C. so that a parent phase will take the form of a ferrite phase or a phase composed of ferrite and granulated and/or platy cementite. It is contrived that a ferrite phase contains Al of 7 to 25 wt % coexistent with a mixture of copper, Ni and Mn of 6 to 35 wt % at which an age-hardening of the ferrite phase remarkably appears. The present invention proposes that a parent phase contains Al and carbon of 1.5 to 25 wt % and takes the form of a martensite phase having an order transformation. Especially, it is preferable from the viewpoint of lubricating property that cementite is pearlitely dispersed in the age-hardened ferrite phase.

FIG. 9 is a photograph showing a typical metallographical structure of a rapidly cooled chilled cast iron (Ni-hard containing Ni of 4 wt % and Cr of 2 wt %). The structure comprises white cementite having directivity, ledeburite (a eutectic structure), corroded martensite and pearlite. Since the ferrite phase has a microscopic structure, it cannot be distinguished. A heating at 400 to 750° C. causes the martensite phase to be separated into a ferrite phase having an ordered phase and cementite, and causes pearlite to be separated into a ferrite phase having an ordered phase and platy cementite. From the results, in the present invention, it is contrived that a ferrite phase contained in the corroded portion has an ordered phase and is age-hardened to have hardness of Hv500 or more. And, it is contrived that it is comprised of the martensite.

FIG. 10 is a photograph showing a structure of the chilled cast iron as shown in FIG. 9 which is graphitized so as to graphitize a part of cementite. This figure shows that a content of cementite decreases resulting in the cementite segmentizing and forming a fine-grained structure, and precipitated graphite particles has a fine-grained structure so that excellent toughness can be provided. In the present invention, it is contrived that the ferrite phase is applied to the corroded parent phase and a martensite phase (partially containing bainite and troostite and having a hardness of Hv500 or more) is mainly applied thereto.

In addition, it is preferable that a quenching treatment using the induction heating is applied so as to disperse cementite pearlitely in the martensite parent phase.

Almost all of cementite described in the claim 4 and the claim 8 is graphitized so as to disperse as a fine grained graphite particles, as described in the claim 3 and the claim 7 (as shown in FIG. 8D).

Since a ferrous abrasion resistant sliding material having a parent phase taking the form of a ferrite phase requires a large addition amount of expensive alloy element such as Ni and Co, it is preferable to have a parent phase taking the form of a martensite phase composing of iron, aluminum and carbon from an economical viewpoint.

Al does not suppress graphitization, and almost of all is discharged from cementite. Accordingly, when a casting material is produced at a chilled cast iron state as shown in FIG. 9, Al is concentrated in a parent phase thereof. For example, in a case of a casting material containing cementite precipitated therein in 50% by volume, an addition of Al of 1.5 wt % causes Al of 3 wt % contained in a parent phase, resulting in showing a remarkable order transformation. Ni and Co are discharged from cementite and concentrated in a ferrite phase and a martensite phase as well as Al so that it is preferable from an economical viewpoint to disperse a large amount of cementite.

Since solid solubility of copper with a parent phase of a ferrous abrasion resistant sliding material is about 5 wt %, an addition of copper of 5 wt % or more enables having a structure in which copper alloy phase is granularly dispersed in the casting material. Thus, the structures in which copper alloy phase is dispersed in the structures shown in FIG. 8, FIG. 9 and FIG. 10 are also preferable.

In order to more improve abrasion resistance of a ferrous abrasion resistant sliding material, it is preferable that MC-type carbide such as $V_4C_3$ is dispersed in the structures shown in FIG. 8 to FIG. 10.

Figure 11:
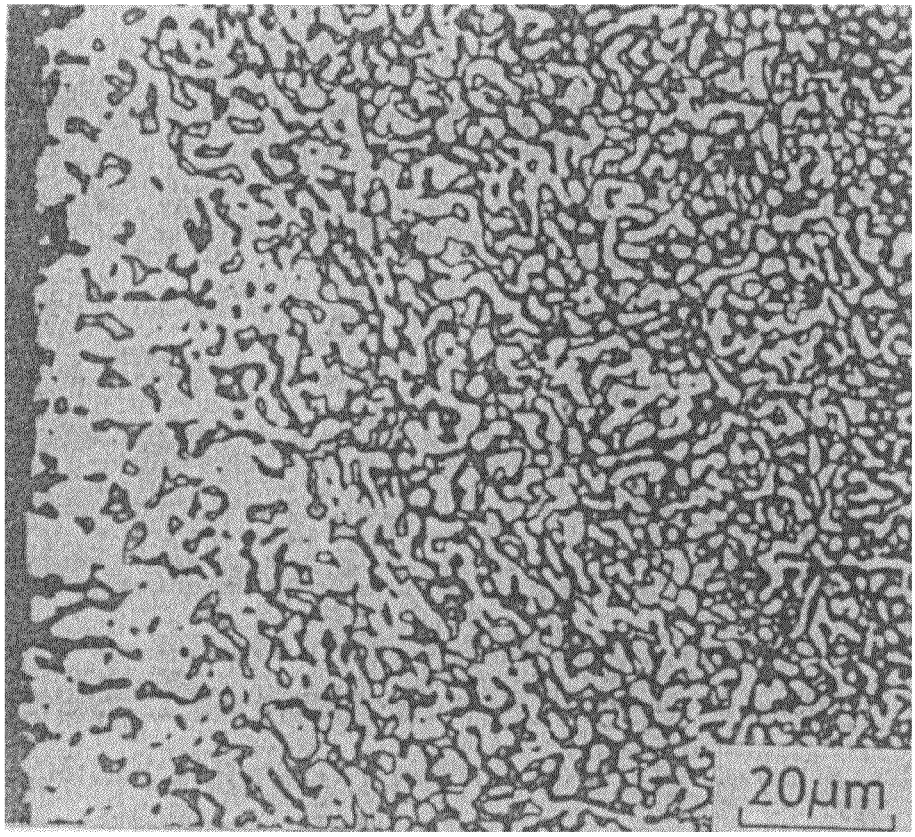
FIG. 11 is a photograph showing a structure of a carburized surface layer of a Fe-12Cr steel.

FIG. 11 is a photograph showing a typical metallographical structure of the aforesaid ferrous abrasion resistant sliding material available for producing using a carburizing process or a carbonitriding process. Since a portion required abrasion resistance and seizing resistance is limited to a sliding surface layer of a floating seal, excellent toughness can be obtained for the floating seal device. And, since a carburizing treatment or a carbonitriding treatment allows cementite and $V_4C_3$ carbide to be precipitated in a high density, a floating seal excellent in abrasion resistance can be produced. In addition, a floating seal can be produced inexpensively because a base material thereof is processed by one or more inexpensive process such as a forging process, a rolling process, a bending process and a machining process when it is soft before carburizing and carbonitriding. It is more preferable that a carburized floating seal has a martensite parent phase containing Al.

Example 2

Figure 12A:
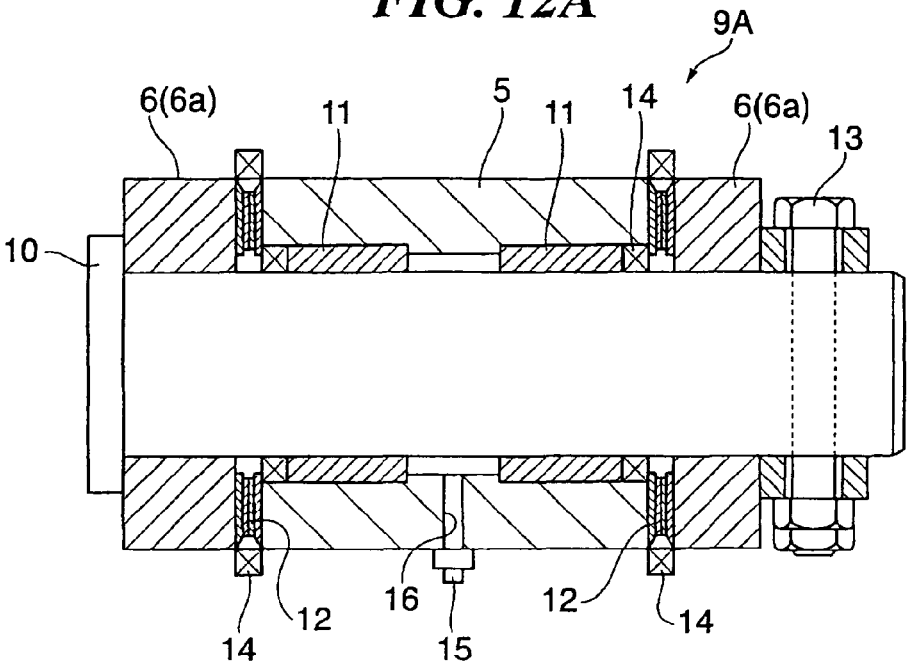
FIG. 12A and FIG. 12B are drawings schematically showing a connecting device.
Figure 12B:
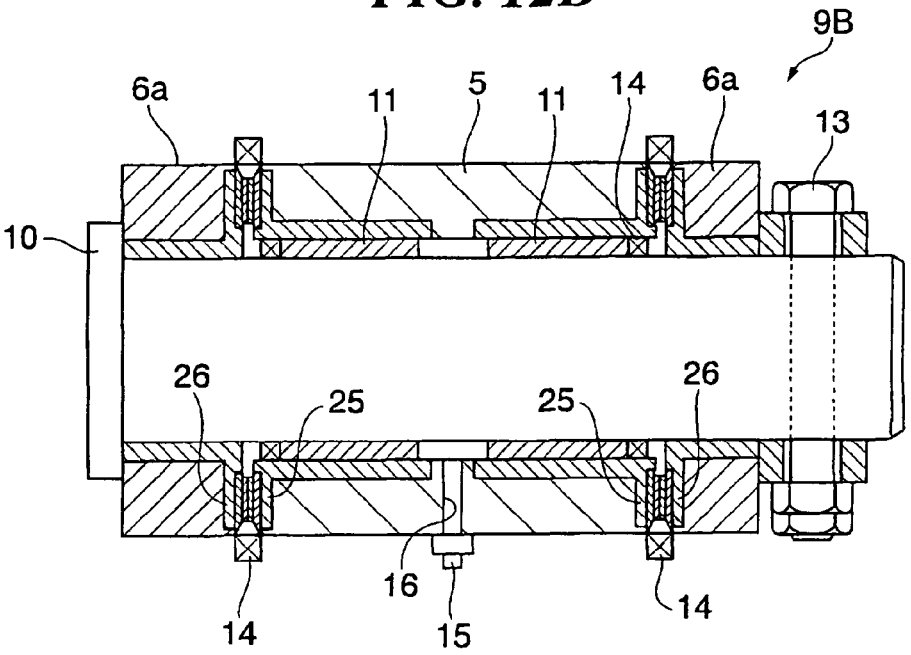
Figure 13A:
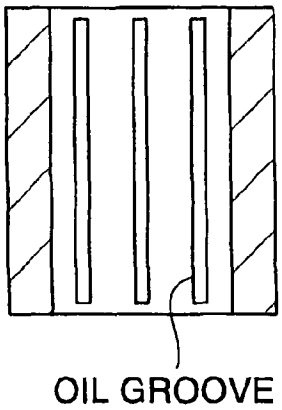
FIG. 13A to FIG. 13D are drawings showing various bearings.
Figure 13B:
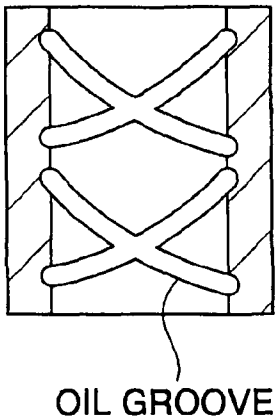
Figure 13C:
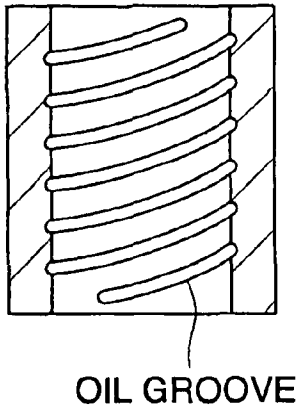
Figure 13D:
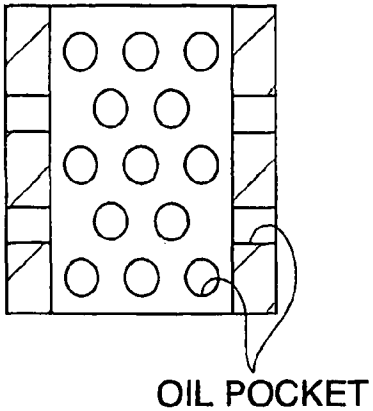

Next, embodiments in which a material according to the present invention is applied to a bearing and a thrust bearing will be explained. FIG. 12A and FIG. 12B are drawings schematically showing a connecting device. FIG. 13 is a drawing showing a typical structure of a bearing slid with respect to an outer surface of a pin.

The connecting device, according to the present invention, is used as a boom connecting device for connecting a boom of a hydraulic excavator to a rotating body, an arm connecting device for connecting an arm to a boom and a bucket connecting device for connecting a bucket to an arm. First, the bucket connecting device 9A shown in FIG. 12A will be explained. The bucket connecting device 9A is provided with a bucket 6, a connecting pin 10, and thrust bearings 12. The bucket 6 is rotatably connected to an arm 5 by the thrust bearings 12 via a bearing (bushing) 11. A thrust load between the bucket 6 and the arm 5 is applied to the thrust bearing 12. The bearing 11 is fitted onto the connecting pin 10 which is supported by brackets **6*a* formed on the bucket 6, and is pushed into a distal end of the arm 5. The connecting pin 10 is fixed to the bracket 6*a* by a bolt 13. A seal member 14 and a lubricating oil supply port 15, a lubricating oil supply passage 16** are shown in the figure.

Next, another bucket connecting device 9B shown in FIG. 12B will be explained. The bucket connecting device 9B is provided with a thrust bearing 25 pushed into the arm 5 and a thrust bearing 26 disposed at the bracket **6*a*. Each of the bearings 25, 26** has a collar.

The bearing 11 of the bucket connecting devices 9A and 9B may have various structures shown in FIG. 13A to FIG. 13D. The structure shown in FIG. 13A to FIG. 13C has an oil groove on a sliding surface, and a structure shown in FIG. 13D has an oil pocket on a sliding surface. In the oil groove and the oil pocket, various types of grease (preferably containing a solid lubrication), a plastic containing a lubricating oil, and graphite is received preferably. This enables remarkable lengthening a lubrication interval of the bearing 11. At this time, it is preferable that the groove and the pocket are previously formed by casting from an economical viewpoint.

Figure 14:
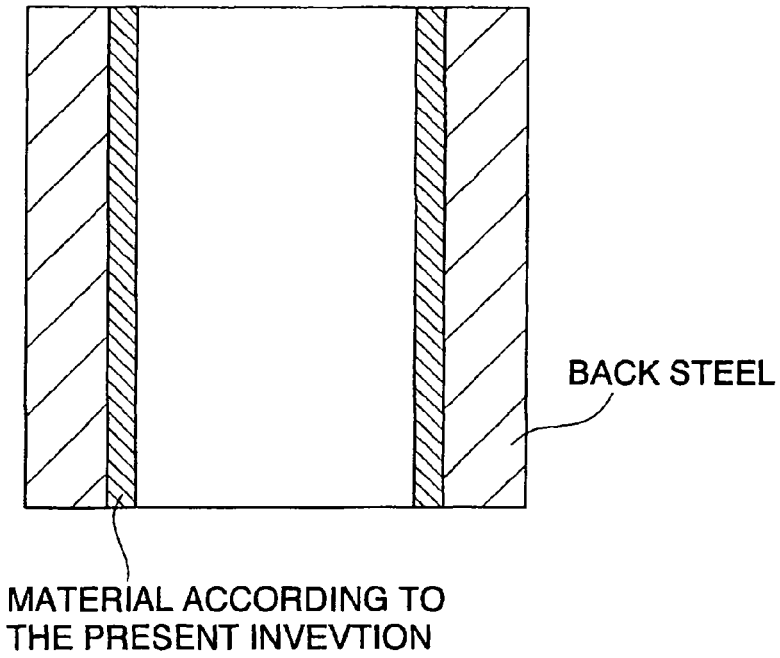
FIG. 14 is a drawing showing a double bearing by a casting joining.

As shown in FIG. 14, it is preferable that the ferrous abrasion resistant sliding material is applied to a double bearing which is joined to a ferrous back steel by a casting process. In such a case, the ferrous abrasion resistant sliding material preferably contains graphite dispersed therein in 10 to 15% by volume so that a lubricating oil will be retained in the graphite. In addition, the graphite is preferably flake graphite. The double bearing is joined to the back steel by not only casting but also brazing and adhesion.

Producing such the bearing by a centrifugal casting process causes a large amount of graphite having a small gravity to be dispersed in an inner surface of the bearing. This provides a bearing having excellent lubricating property and capable of lengthening a lubricating interval.

Especially, the double bearing shown in FIG. 14 has high rigidity and economical efficiency, and enables preventing induced turning and slipout of the bearing.

Figure 15A:
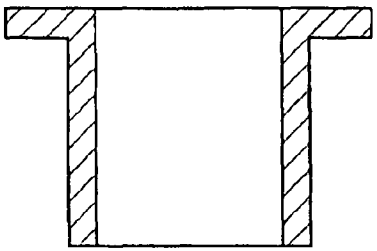
FIG. 15 are drawings showing a structure of a bearing having a thrust sliding surface and shapes of grooves on the sliding surface.
Figure 15B:
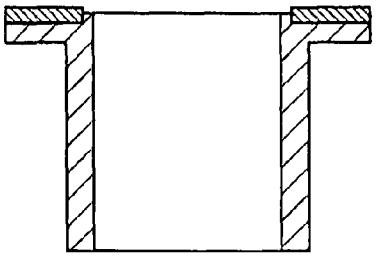
Figure 15C:
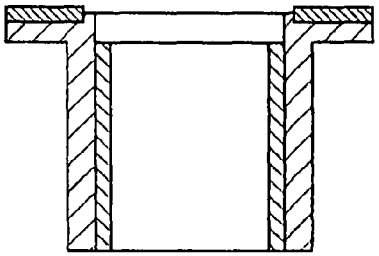
Figure 15D:
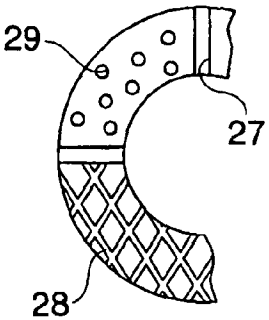

FIG. 15A to 15C are drawings showing various structures of thrust bearing of the connecting device. The thrust bearing slides while receiving a thrust load to the collar portion thereof and a radial load to the inner surface thereof. The collar portion to which thrust load is applied requires to have sufficient abrasion resistance against earth and sand because it is used under a severe lubricating condition in which heat crack and seizing easily occur. Accordingly, it is preferable that such the portion to which a thrust load is applied is produced by using a ferrous abrasion resistant sliding material which contains at least carbide (cementite) in a content of 5 to 40% by volume and further graphite in a content of 3 to 10% by volume dispersed therein. And, it is also preferable that the collar portion and/or the inner surface portion have a groove or a pocket where a lubricating oil is received. In addition, a thrust bearing which slides while receiving a thrust load to only the collar portion, as shown in FIG. 15, is also included. In the present invention, as shown in FIG. 15D, it is preferable to have a groove (a bent groove 27, a diamond shaped groove 28) or a pocket (a dimple or a hole 29) for easily supplying a lubricating grease and a lubricating composition to a sliding surface so as to improve seizing resistance and heat crack resistance.

A ferrous abrasion resistant sliding material according to the present invention is suited not only the aforesaid connecting device but also to a bearing having substantially the same sliding mechanism as the aforesaid connecting device. The sliding mechanism may have various shaped sliding surfaces including a columnar shape, a cylindrical shape, a plane shape and a spherical shape so that the bearing may be applied to a bearing used for an equalizer which supports a body of a bulldozer and a suspension device of a dump truck and a wheel loader.

Example 3

Figure 16:
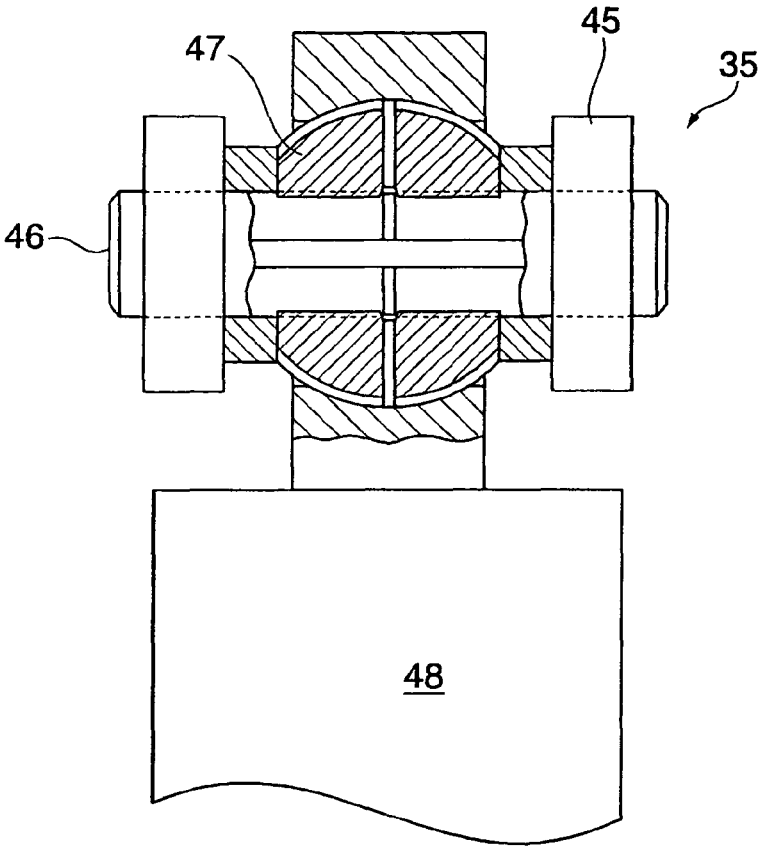
FIG. 16 is a drawing showing a principle part of a structure of a suspension.

FIG. 16 is a drawing showing a spherical bearing used for a suspension device. In the suspension device 35, a pin 46 supported by a component of the device is rotatably and turnably connected to a suspension 48 by a spherical bushing (degree of freedom of 2) 47 which is fitted onto the pin 46. The connecting portions of the bushing 47 to the pin 46 and the suspension 48 are made by using a ferrous abrasion resistant sliding material according to the present invention, whereby the same effect as the examples 1 and 2 can be obtained.

Example 4

Figure 17:
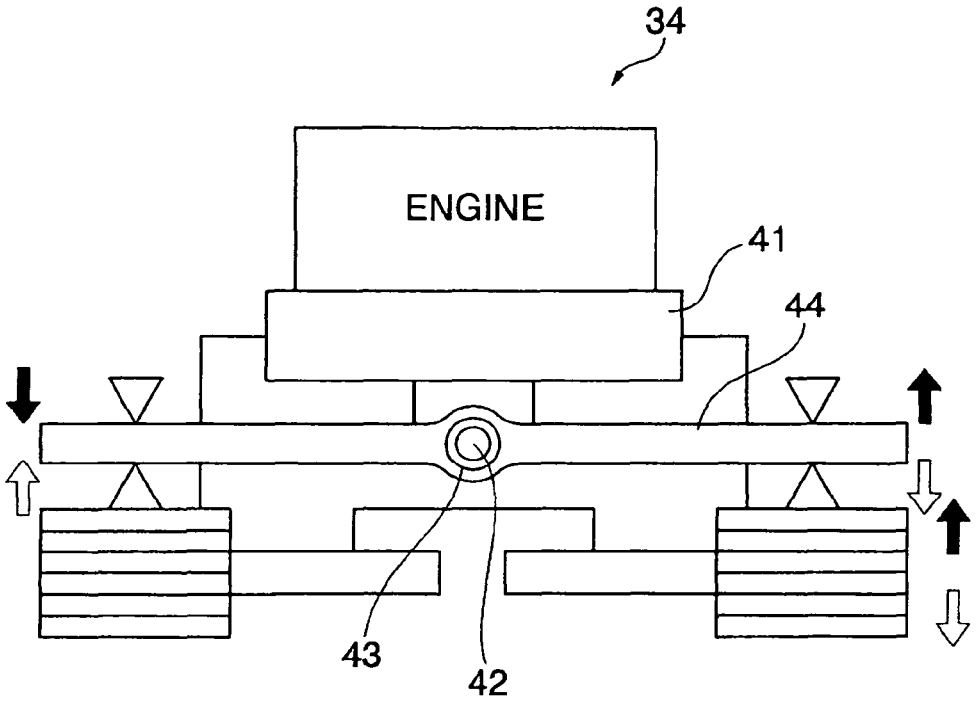
FIG. 17 is a drawing schematically showing a structure of an equalizer.

FIG. 17 is a drawing showing a spherical bearing used for an equalizer. In the equalizer 34, a main frame 41 is rotatably and turnably connected to an equalizer bar 44 by an equalizer bush 43, which is fitted onto the equalizer pin 42. The connecting portions of the equalizer bushing 43 to the main frame 41 and the equalizer bar 44 are made by a ferrous abrasion resistant sliding material according to the present invention, whereby the same effect as the foresaid examples can be obtained.

Example 5

Figure 18:
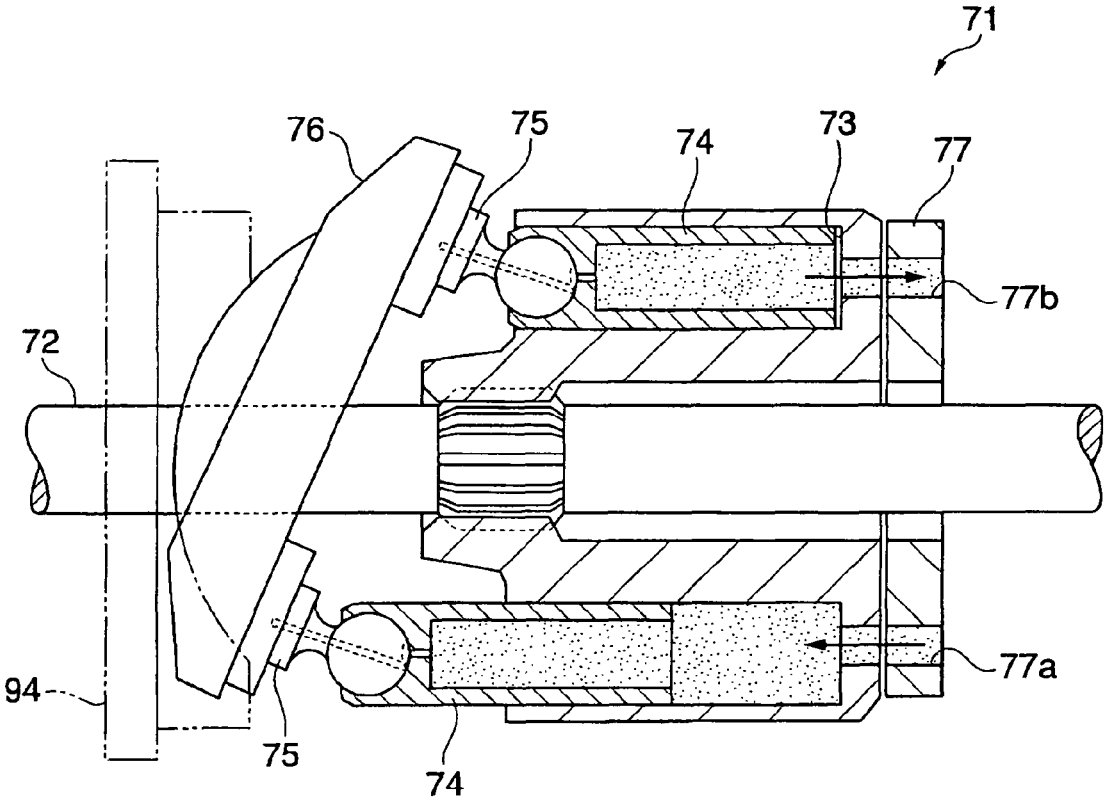
FIG. 18 is a drawing schematically showing a principle part of a structure of an in-line hydraulic piston pump.

FIG. 18 is a drawing showing a principle part of an in-line hydraulic piston pump or motor.

The in-line hydraulic piston pump or motor 71 according to the present invention is provided with a drive shaft 72 and a cylinder block 73 on an axis. In a case of a hydraulic pump, rotating the block 73 by using an engine causes a piston 74 to be rotated therewith. As a result, a piston shoe 75 with a spherical head which is fitted on one end of the piston 74 is slid with respect to a rocker cam 76 disposed at an angle to the drive shaft 72, causing a reciprocating motion of the piston 74. This causes an oil sucked via an inlet port 77*a* of a valve plate 77 to be compressed and to be discharged from an outlet port 77*b* of the valve plate 77. On the other hand, in a case of a hydraulic motor, a compressed oil is poured from a valve plate 77 in a bore of a cylinder block 73. This causes the piston shoe 75 to be slid with respect to the rocker cam 76, and therefore to be rotated with the cylinder block 73.

In each case of the pump and the motor, the piston shoe 75 is slid at a high speed while being pressed against the rocker cam 76 by the compressed oil. And, the pump and the motor have many sliding surfaces such as engagement surfaces between the piston 74 and the bore of the cylinder block 73, between a cradle 94 and the rocker cam 76, and between the cylinder block 73 and the valve plate 77. Consequentially, it is preferable that one or more of the sliding surfaces is made of a ferrous abrasion resistant sliding material according to the present invention.

A ferrous abrasion resistant sliding material according to the present invention may be employed for an angled piston pump, an angled piston motor, a radial pump and a radial motor other than the aforesaid in-line hydraulic pump and motor.

Example 6

Figure 19:
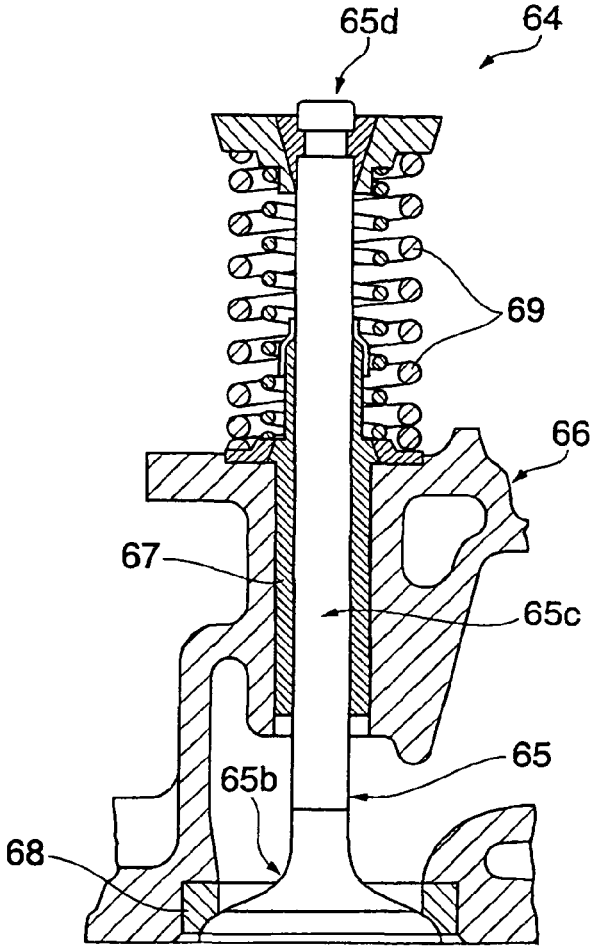
FIG. 19 is a drawing showing a structure of a valve of an engine valve.

FIG. 19 is a drawing schematically showing a valve device for engine.

A valve device 64, according to the present invention, is provided with a valve 65 openable and closable a combustion chamber of an engine (not shown) and a valve guide 67 mounted at a predetermined position of a cylinder head 66 so as to guide the valve 65. And, the valve device 64 is provided with a valve seat 68, a valve spring 69, a rocker arm, a cam shaft and a timing gear, a timing belt, a crank shaft and a timing gear and the like.

In the valve device 64, a valve stem 65*c* is slid with respect to the valve guide 67 at a surface thereof. Accordingly, it is preferable that such the surface is made of a ferrous abrasion resistant sliding material according to the present invention.

Example 7

Figure 20:
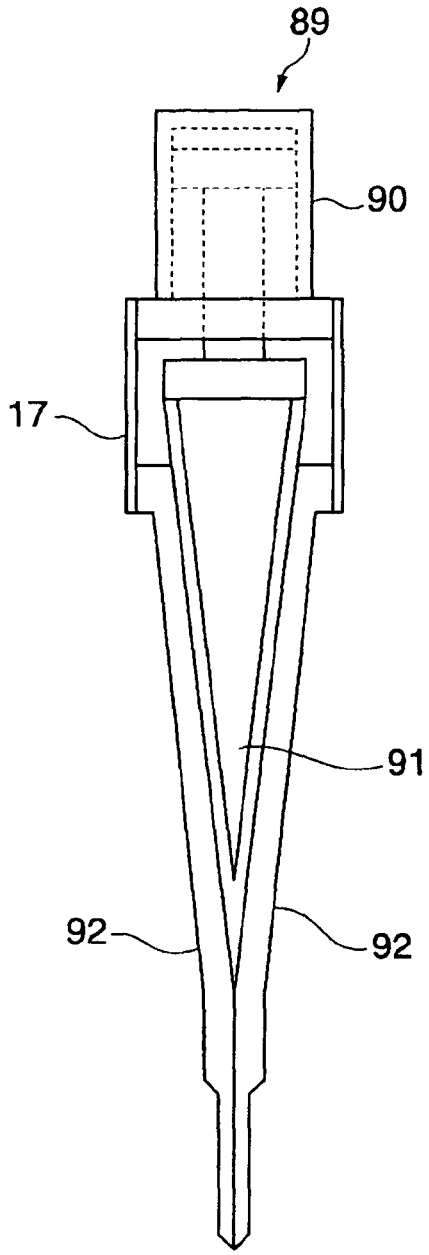
FIG. 20 is a drawing showing a structure of a rock breaking equipment.

FIG. 20 is a drawing schematically showing a rock breaking equipment (a power splitter).

The rock breaking equipment 89 is provided with a wedge 91 operated by a hydraulic cylinder (a thrust generating means) 90 and one pair of guides 92 disposed at both outsides of the wedge 91. The wedge 91 is slid with respect to the guide 92 by the hydraulic cylinder 90, as a result, the thrust applied by the hydraulic cylinder 90 separates the guides 92 depart away, causing crushing a rock.

The rock breaking equipment 89 constructed described above works such that the wedge 91 is slowly thrust down by hydraulic power so as to separate the guides 92 depart away. This generates power for crushing a rock. At this time, since a large pressure is applied to a sliding surface of the wedge 91 and a sliding rate is slow, adhesion and abrasion are likely to occur at the sliding surface. Accordingly, a double sliding material in which the bottom sliding surface of the wedge 91 or the guide 92 is integrated with one or more material of the ferrous abrasion resistant sliding materials according to the present invention is used so as to obtain large power for crushing a rock and to decrease a running cost.

Embodiment

Embodiments of a ferrous abrasion resistant material and a sliding part using the same will be explained.

Figure 21:
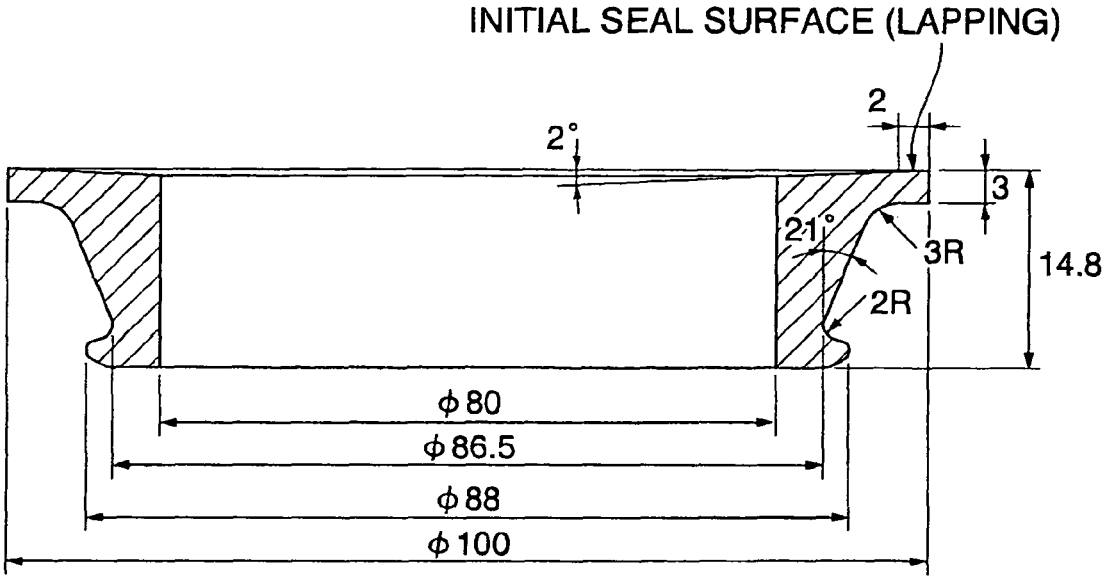
FIG. 21 is a cross sectional drawing showing a structure of a floating seal.
Figure 22:
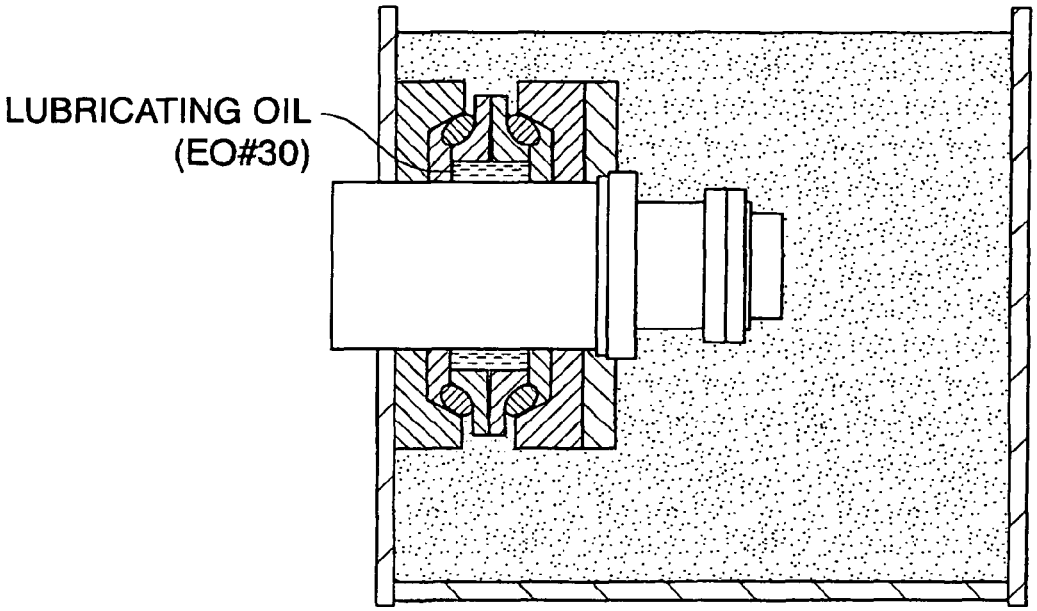
FIG. 22 is a drawing showing a structure of a floating seal tester.

In this embodiment, casting floating seal materials and casting comparative materials shown in Table 1 were used. Each of the materials was cast in a shell-shaped mold and then quenched to prepare fusil specimens and comparative fusil specimens. On the other hand, after being cast in a shell-shaped mold, each of the materials was re-heated (graphitized) at 950° C. and then quenched to prepare fusil specimens and comparative fusil specimens. Then, each of the comparative fusil specimens and the fusil specimens were machined to have a floating seal ring shape, as shown in FIG. 21, and then lapping treatment was applied to a seal surface (shown in the figure) thereof. Then, seizing resistance of each of the seal surface of both the seal ring specimens was measured by using a floating seal tester, as shown in FIG. 22. The floating seal tester used a floating seal device, in which each of the prepared floating seal ring specimens was used as a pair of seal rings with the seal surfaces contacted each other. And, an O-ring which pressed one of the seal ring was rotated around a central axis of the seal rings with respect to a fixed O-ring which pressed another seal ring with applying load. The seizing resistance was evaluated by using a PV value. The PV value (PxV, kgf/cm·m/sec) was obtained when seizing resistance rapidly increased while changing a rotating rate (a revolution rate V) under a condition in which press load between the seal surfaces was kept at 63 kgf (press pressure P was 2 kgf/cm) to enclose engine oil (EO#30). The results are shown in "limited PV value 1" in a right column of the table 1. An abrasion amount in table 1 shows a moving distance (mm) of a seal surface contact portion when the seal tester as shown in FIG. 22 is operated at a press pressure P of 2 kgf/cm and a revolution rate V of 1 m/sec for 500 hours in water containing $SiO_2$ particles in 50%. Characteristics of the floating seal material are also shown.

ing property is not stabilized due to occlusion of pores on a sliding surface, whereby a porosity of 7% or more by volume is required for stabilization of the lubricating property. As shown in No. 1 to No. 6, an improvement of a limited PV value improves abrasion resistance.

No. 6 to No 9 are alloys in which cementite, copper alloy phase and $Cr_7C_3$ carbide, which are crystallizes by chilling is dispersed in a ferrite parent phase, respectively. These alloy elements show an excellent limited PV value (seizing resistance and heat crack resistance) and excellent abrasion resistance. However, as shown in FIG. 8, an appearance of copper alloy phase decreases abrasion resistance.

No. 10 to No. 16 are alloys having a parent phase taking the form of a martensite phase. No. 10 is an alloy element in which graphite and $V_4C_3$ carbide are dispersed in 10% by volume, improving seizing resistance and abrasion resistance. And, dispersing a large amount of cementite as shown in No. 11 and No. 12 improves abrasion resistance remarkably. In addition, dispersing copper alloy phase as shown in No. 15 improves seizing resistance.

As shown in No. 14 and No. 15, dispersing $Cr_7C_3$ carbide improves abrasion resistance. As shown in No. 16, an addition

TABLE 1

COMPOSITION (wt %) AND PV VALUE OF FLOATING SEAL MATERIALS

| No. | C | Si | Mn | Ni | Cr | Mo | V | Co | W | P | Al | Cu | PV VALUE 1 | ABRASION AMOUNT | COMPOSITION |
|---|---|---|---|---|---|---|---|---|---|---|---|---|---|---|---|
| No. 1 | 0.05 | 0.39 | 0.53 | 2.53 | 0.28 | | | 20.1 | | | 14.9 | | 3.9 | 4.4 | α |
| No. 2 | 2.01 | 0.41 | 0.52 | 2.48 | 0.29 | | | 20.2 | | | 15 | | 4.9 | 3.9 | α + Gr |
| No. 3 | 4.15 | 0.51 | 0.51 | 2.51 | 0.31 | | | 10 | | | 10.3 | | 5.4 | 3.7 | α + Gr |
| No. 4 | 4.15 | 0.51 | 0.51 | 2.51 | 0.31 | | | 20 | | | 15.1 | | 6.3 | 3.8 | α + Gr |
| No. 5 | 4.25 | 2.56 | 0.45 | 7.3 | 0.35 | | | 15 | | | 14.9 | | 6.1 | 3.4 | α + Gr |
| No. 6 | 4.18 | 0.52 | 0.38 | 15.2 | 0.33 | | | 5 | | | 11.3 | | 5.5 | 3.2 | α + Gr |
| No. 7 | 3.72 | 1.22 | 0.41 | 13.5 | 2.31 | | | 0.01 | | | 5.81 | | 6.1 | 2.3 | α + θ |
| No. 8 | 3.81 | 1.19 | 0.6 | 2.31 | 2.18 | | 2.51 | 10.3 | | | 6.81 | 15.6 | 6.8 | 3.1 | α + θ + Cu |
| No. 9 | 3.62 | 1.52 | 0.51 | 2.45 | 16.1 | 2.01 | 0.66 | 10.2 | | | 6.21 | | 5.8 | 2 | α + $Cr_7C_3$ |
| No. 10 | 3.99 | 2.12 | 0.55 | 1.01 | 0.15 | 0.11 | 2.01 | | | | 5.21 | | 5.2 | 2.9 | M + Gr |
| No. 11 | 3.66 | 2.55 | 1.56 | 0.02 | 2.98 | 0.13 | | | | | 2.52 | | 5.1 | 2.2 | M + θ |
| No. 12 | 2.53 | 0.61 | 0.97 | 2.53 | 1.51 | 0.31 | | | | | 4.12 | | 5.5 | 2.8 | M + θ |
| No. 13 | 3.51 | 0.98 | 0.69 | 2.51 | 1.38 | | | | | | 5.02 | 15.2 | 5.8 | 3.3 | M + θ + Cu |
| No. 14 | 3.62 | 0.61 | 0.62 | 0.03 | 15.5 | 2.63 | 0.39 | | | — | 5.10 | 0.03 | 4.5 | 1.7 | M + $Cr_7C_3$ |
| No. 15 | 3.43 | 0.62 | 0.57 | 0.02 | 15.8 | 2.62 | 0.41 | | | — | 4.80 | 9.20 | 5.2 | 2 | M + $Cr_7C_3$ + Cu |
| No. 16 | 3.05 | 0.65 | 0.56 | 0.02 | 25.7 | 2.63 | 0.45 | | | | 3.27 | | 5.6 | 1.4 | LM + $Cr_7C_3$ |
| $FC_{15}Cr_3Mo$ | 3.56 | 1.58 | 0.59 | 2.21 | 15.5 | 2.31 | 0.44 | | | | | | 1.8 | 3.2 | M + $Cr_7C_3$ |
| $FC_9Cr_6Mo$ | 3.20 | 1.22 | 0.51 | 1.70 | 9.20 | 6.10 | 2.13 | 4.98 | 4.92 | | | | 2.5 | 2.3 | M + $Cr_7C_3$ + $M_6C$ |
| CHILLED CAST IRON | 3.22 | 2.59 | 0.62 | 0.05 | 0.97 | 0.42 | 0.01 | | | | | 1.65 | 1.7 | 4.2 | M + θ |
| Nihard | 3.41 | 2.49 | 0.47 | 4.82 | 2.06 | 0.06 | | | | 0.02 | | | 2.3 | 3.8 | M + θ |
| GRAPHITIZED Ni-hard | 3.41 | 2.49 | 0.47 | 4.82 | 2.06 | 0.06 | | | | 0.02 | | | 3.2 | 4.3 | M + Gr + θ |

PV VALUE (kgf/cm · m/sec),
ABRASION AMOUNT (mm)

The comparative materials include $FC_{15}Cr_3Mo$, $FC_9Cr_6Mo_5W$, chilled cast iron and a Ni-hard cast iron, which are widely employed as a floating seal.

No. 1 to No. 9 are alloys each having a parent phase taking the form of a ferrite phase which is age-hardened (600° C., 3 hours). No. 1 having only a parent phase taking shows an excellent seizing resistance and heat crack resistance compared with the comparative materials. In addition, as an amount of graphite increases, a limited PV value is improved. And, No. 2 (containing graphite in 6.5% by volume) shows that a limited PV value is remarkably improved. This is corresponsive with the fact that a material for an oil retaining bearing, which has a porosity of 3% or more by volume, shows excellent lubricating property, however, the lubricatof an increased amount of Cr decrease a solid soluble concentration of carbon with the martensite phase, improving seizing resistance.

And, an alloy (graphitized Ni-hard as shown in FIG. 10, containing graphite in about 3% by volume), in which a chilled Ni-hard cast iron is graphitized at 960° C. so as to disperse fine graphite particles having an average grain size of 5 μm and to decrease an amount of cementite as well as form a fine-grained structure, has improved seizing resistance. At this time, it is preferable that the lower limit of a precipitating amount of graphite is about 3% by volume.

What is claimed is:

1. A ferrous abrasion resistant sliding material having a parent phase taking the form of a ferrite phase, wherein said parent phase contains Al of 10.3 to 20 wt %, and at least one carbide selected from the group consisting of cementite, $Cr_7C_3$-type carbide, $Fe_3M_3C$-type carbide and MC-type carbide, or graphite is dispersed therein, wherein said ferrous abrasion resistant sliding material is steel or cast iron, wherein said ferrite phase is age-hardened so that the ferrite phase has a hardness of Hv500 or more, and wherein said material contains one or more alloy element selected from the group consisting of Si, Mn, Ni and Co in a total amount of 2 to 7 wt % and a retained austenite phase in a content of 10 to 40% by volume.

2. The ferrous abrasion resistant sliding material according to claim 1, wherein said parent phase contains Si of 5 wt % or less.

3. The ferrous abrasion resistant sliding material according to claim 1, wherein said material contains carbon of 2.5 to 5 wt %, said ferrite phase contains one or more alloy element selected from the group consisting of Ni, Co and Mn of 6 to 35 wt %, and said material contains one or more graphite selected from the group consisting of flake graphite, granulated graphite and vermicular graphite dispersed in said ferrite phase in 3 to 15% by volume.

4. The ferrous abrasion resistant sliding material according to claim 1, wherein said material contains carbon of 0.4 to 5 wt %, said ferrite phase contains one or more of alloy element selected from the group consisting of Ni, Co and Mn of 6 to 35 wt %, and said material contains carbide dispersed in said ferrite phase in 5 to 75% by volume.

5. The ferrous abrasion resistant sliding material according to claim 1, wherein said material contains carbon of 0.4 to 5 wt %, said ferrite phase contains one or more of alloy element selected from the group consisting of Ni, Co and Mn of 6 to 35 wt %, and said material contains a copper alloy phase dispersed in said ferrite phase in 3 to 20% by volume.

6. The ferrous abrasion resistant sliding material according to claim 1, wherein said material contains carbon of 2.5 to 5 wt % and has a fundamental structure in which said ferrite phase contains cementite in a content of 5 to 40% by volume and graphite in a content of 3 to 10% by volume dispersed therein.

7. The ferrous abrasion resistant sliding material according to claim 1, wherein said graphite has an average grain size of 10 μm or less and is dispersed in said parent phase in 3 to 10% by volume.

8. The ferrous abrasion resistant sliding material according to claim 1, wherein said parent phase contains a copper alloy phase dispersed therein, and said copper alloy phase contains Al of 7 to 15 wt % so as to have a structure of a mixture of a α phase and a β phase or a β phase.

9. The ferrous abrasion resistant sliding material according to claim 1, wherein said material contains one or more alloy element selected from the group consisting of Cr of 2.5 to 25 wt %, Mo of 3 to 15 wt % and W of 3 to 15 wt % so that said parent phase contains one or more carbide selected from the group consisting of cementite, $Cr_7C_3$-type carbide, $Fe_3M_3C$-type carbide and MC-type carbide precipitated and dispersed therein in 5 to 75% by volume.

10. The ferrous abrasion resistant sliding material according to claim 1, wherein said material contains one or more of Cr of 2.5 to 25 wt %, Mo of 3 to 15 wt % and W of 3 to 15 wt %, and a sliding surface of said material is carburized to have said parent phase containing one or more carbide selected from the group consisting of cementite, $Cr_7C_3$-type carbide, $Fe_3M_3C$-type carbide and MC-type carbide precipitated and dispersed therein in 5 to 75% by volume.

11. The ferrous abrasion resistant sliding material according to claim 1, wherein said material contains one or more alloy element selected from the group consisting of V, Ti, Zr, Nb and Ta of 0.05 to 4 wt % so that one or more of carbide, nitride and carbonitride mainly formed by said alloy element is dispersed in 0.1 to 10% by volume.

* * * * *